US008111212B2

(12) United States Patent
Itakura et al.

(10) Patent No.: US 8,111,212 B2
(45) Date of Patent: Feb. 7, 2012

(54) METHOD FOR DRIVING PLASMA DISPLAY PANEL

(75) Inventors: Shunsuke Itakura, Chuo (JP); Koji Hashimoto, Chuo (JP)

(73) Assignee: Panasonic Corporation, Osaka (JP)

( * ) Notice: Subject to any disclaimer, the term of this patent is extended or adjusted under 35 U.S.C. 154(b) by 1036 days.

(21) Appl. No.: 12/027,729

(22) Filed: Feb. 7, 2008

(65) Prior Publication Data

US 2008/0198099 A1 Aug. 21, 2008

(30) Foreign Application Priority Data

Feb. 19, 2007 (JP) ..... 2007-038469

(51) Int. Cl.
*G09G 3/28* (2006.01)

(52) U.S. Cl. ..... 345/60

(58) Field of Classification Search ..... 345/37–42, 345/55, 60–68; 315/169.1–169.4
See application file for complete search history.

(56) References Cited

U.S. PATENT DOCUMENTS

| | | | | |
|---|---|---|---|---|
| 6,097,358 | A * | 8/2000 | Hirakawa et al. | 345/63 |
| 6,144,364 | A * | 11/2000 | Otobe et al. | 345/691 |
| 6,342,874 | B1 * | 1/2002 | Tokunaga et al. | 345/68 |
| 6,614,413 | B2 * | 9/2003 | Tokunaga et al. | 345/63 |
| 6,724,356 | B1 * | 4/2004 | Kojima et al. | 345/60 |
| 7,463,220 | B2 * | 12/2008 | Sakata et al. | 345/60 |
| 7,633,465 | B2 * | 12/2009 | Sakata et al. | 345/60 |

FOREIGN PATENT DOCUMENTS

JP 2006-054160 A 2/2006

* cited by examiner

*Primary Examiner* — Richard Hjerpe
*Assistant Examiner* — Carolyn R Edwards
(74) *Attorney, Agent, or Firm* — Sughrue Mion, PLLC

(57) ABSTRACT

A plasma display driving method in which, in an erase stage of a last sub-field of a one-field display period, a scanning pulse is sequentially applied to one row electrode of each of the row electrode pairs for each scanning line or for each scanning line group having a plurality of scanning lines, while an erase pulse is applied to column electrodes simultaneously with the application of the scanning pulse, to cause an erase discharge between the one row electrode and each of the column electrodes to which the erase pulse is applied.

24 Claims, 16 Drawing Sheets

FIG. 6

| GRADATION DRIVE | DATA CONVERSION TABLE | | LIGHT EMISSION PATTERN | | | | | | | | | | | | | | DISPLAY LUMINANCE |
|---|---|---|---|---|---|---|---|---|---|---|---|---|---|---|---|---|---|
| | PDs | GD 1 2 3 4 5 6 7 8 9 10 11 12 13 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1ST | 0000 | 0 0 0 0 0 0 0 0 0 0 0 0 0 0 | | | | | | | | | | | | | | | 0 |
| 2ND | 0001 | 1 1 0 0 0 0 0 0 0 0 0 0 0 0 | ◎ | ● | | | | | | | | | | | | | 1 |
| 3RD | 0010 | 1 0 1 0 0 0 0 0 0 0 0 0 0 0 | ◎ | ○ | ● | | | | | | | | | | | | 3 |
| 4TH | 0011 | 1 0 0 1 0 0 0 0 0 0 0 0 0 0 | ◎ | ○ | ○ | ● | | | | | | | | | | | 9 |
| 5TH | 0100 | 1 0 0 0 1 0 0 0 0 0 0 0 0 0 | ◎ | ○ | ○ | ○ | ● | | | | | | | | | | 17 |
| 6TH | 0101 | 1 0 0 0 0 1 0 0 0 0 0 0 0 0 | ◎ | ○ | ○ | ○ | ○ | ● | | | | | | | | | 27 |
| 7TH | 0110 | 1 0 0 0 0 0 1 0 0 0 0 0 0 0 | ◎ | ○ | ○ | ○ | ○ | ○ | ● | | | | | | | | 39 |
| 8TH | 0111 | 1 0 0 0 0 0 0 1 0 0 0 0 0 0 | ◎ | ○ | ○ | ○ | ○ | ○ | ○ | ● | | | | | | | 55 |
| 9TH | 1000 | 1 0 0 0 0 0 0 0 1 0 0 0 0 0 | ◎ | ○ | ○ | ○ | ○ | ○ | ○ | ○ | ● | | | | | | 73 |
| 10TH | 1001 | 1 0 0 0 0 0 0 0 0 1 0 0 0 0 | ◎ | ○ | ○ | ○ | ○ | ○ | ○ | ○ | ○ | ● | | | | | 95 |
| 11TH | 1010 | 1 0 0 0 0 0 0 0 0 0 1 0 0 0 | ◎ | ○ | ○ | ○ | ○ | ○ | ○ | ○ | ○ | ○ | ● | | | | 119 |
| 12TH | 1011 | 1 0 0 0 0 0 0 0 0 0 0 1 0 0 | ◎ | ○ | ○ | ○ | ○ | ○ | ○ | ○ | ○ | ○ | ○ | ● | | | 147 |
| 13TH | 1100 | 1 0 0 0 0 0 0 0 0 0 0 0 1 0 | ◎ | ○ | ○ | ○ | ○ | ○ | ○ | ○ | ○ | ○ | ○ | ○ | ● | | 179 |
| 14TH | 1101 | 1 0 0 0 0 0 0 0 0 0 0 0 0 1 | ◎ | ○ | ○ | ○ | ○ | ○ | ○ | ○ | ○ | ○ | ○ | ○ | ○ | ● | 215 |
| 15TH | 1110 | 1 0 0 0 0 0 0 0 0 0 0 0 0 0 | ◎ | ○ | ○ | ○ | ○ | ○ | ○ | ○ | ○ | ○ | ○ | ○ | ○ | ○ | 255 |

◎ : WRITE ADDRESS DISCHARGE + SUSTAIN DISCHARGE EMISSION

○ : SUSTAIN DISCHARGE EMISSION

● : ERASE ADDRESS DISCHARGE

FIG. 13

| GRADATION DRIVE | DATA CONVERSION TABLE | | | | | | | | | | | | | | | | | | | | | | | | | | | | | | | LIGHT EMISSION PATTERN | | | | | | | | | | | | | | DISPLAY LUMINANCE |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1ST | 0000 | 0 | 0 | 0 | 0 | 0 | 0 | 0 | 0 | 0 | 0 | 0 | 0 | 0 | 0 | | | | | | | | | | | | | | | 0 |
| 2ND | 0001 | 1 | 0 | 0 | 0 | 0 | 0 | 0 | 0 | 0 | 0 | 0 | 0 | 0 | 0 | □ | | | | | | | | | | | | | | α |
| 3RD | 0010 | 0 | 1 | 1 | 0 | 0 | 0 | 0 | 0 | 0 | 0 | 0 | 0 | 0 | 0 | | ◎ | ● | | | | | | | | | | | | 1 |
| 4TH | 0011 | 1 | 1 | 1 | 0 | 0 | 0 | 0 | 0 | 0 | 0 | 0 | 0 | 0 | 0 | □ | ◎ | ● | | | | | | | | | | | | 1+α |
| 5TH | 0100 | 1 | 1 | 0 | 1 | 0 | 0 | 0 | 0 | 0 | 0 | 0 | 0 | 0 | 0 | □ | ◎ | ○ | ● | | | | | | | | | | | 3+α |
| 6TH | 0101 | 1 | 1 | 0 | 0 | 1 | 0 | 0 | 0 | 0 | 0 | 0 | 0 | 0 | 0 | □ | ◎ | ○ | ○ | ● | | | | | | | | | | 9+α |
| 7TH | 0110 | 1 | 1 | 0 | 0 | 0 | 1 | 0 | 0 | 0 | 0 | 0 | 0 | 0 | 0 | □ | ◎ | ○ | ○ | ○ | ● | | | | | | | | | 17+α |
| 8TH | 0111 | 1 | 1 | 0 | 0 | 0 | 0 | 1 | 0 | 0 | 0 | 0 | 0 | 0 | 0 | □ | ◎ | ○ | ○ | ○ | ○ | ● | | | | | | | | 27+α |
| 9TH | 1000 | 1 | 1 | 0 | 0 | 0 | 0 | 0 | 1 | 0 | 0 | 0 | 0 | 0 | 0 | □ | ◎ | ○ | ○ | ○ | ○ | ○ | ● | | | | | | | 39+α |
| 10TH | 1001 | 1 | 1 | 0 | 0 | 0 | 0 | 0 | 0 | 1 | 0 | 0 | 0 | 0 | 0 | □ | ◎ | ○ | ○ | ○ | ○ | ○ | ○ | ● | | | | | | 55+α |
| 11TH | 1010 | 1 | 1 | 0 | 0 | 0 | 0 | 0 | 0 | 0 | 1 | 0 | 0 | 0 | 0 | □ | ◎ | ○ | ○ | ○ | ○ | ○ | ○ | ○ | ● | | | | | 77+α |
| 12TH | 1011 | 1 | 1 | 0 | 0 | 0 | 0 | 0 | 0 | 0 | 0 | 1 | 0 | 0 | 0 | □ | ◎ | ○ | ○ | ○ | ○ | ○ | ○ | ○ | ○ | ● | | | | 103+α |
| 13TH | 1100 | 1 | 1 | 0 | 0 | 0 | 0 | 0 | 0 | 0 | 0 | 0 | 1 | 0 | 0 | □ | ◎ | ○ | ○ | ○ | ○ | ○ | ○ | ○ | ○ | ○ | ● | | | 133+α |
| 14TH | 1101 | 1 | 1 | 0 | 0 | 0 | 0 | 0 | 0 | 0 | 0 | 0 | 0 | 1 | 0 | □ | ◎ | ○ | ○ | ○ | ○ | ○ | ○ | ○ | ○ | ○ | ○ | ● | | 169+α |
| 15TH | 1110 | 1 | 1 | 0 | 0 | 0 | 0 | 0 | 0 | 0 | 0 | 0 | 0 | 0 | 1 | □ | ◎ | ○ | ○ | ○ | ○ | ○ | ○ | ○ | ○ | ○ | ○ | ○ | ● | 209+α |
| 16TH | 1111 | 1 | 1 | 0 | 0 | 0 | 0 | 0 | 0 | 0 | 0 | 0 | 0 | 0 | 0 | □ | ◎ | ○ | ○ | ○ | ○ | ○ | ○ | ○ | ○ | ○ | ○ | ○ | ○ | 255+α |

α<1

□ : WRITE ADDRESS DISCHARGE + SLIGHT DISCHARGE EMISSION
◎ : WRITE ADDRESS DISCHARGE + SUSTAIN DISCHARGE EMISSION
○ : SUSTAIN DISCHARGE EMISSION
● : ERASE ADDRESS DISCHARGE

METHOD FOR DRIVING PLASMA DISPLAY PANEL

BACKGROUND OF THE INVENTION

1. Field of the Invention

The present invention relates to a method for driving a plasma display panel.

2. Description of the Related Background Art

Plasma display panels of AC type (alternating-current discharge type) have recently been put into production as thin-model displays. A plasma display panel contains two substrates, i.e., a front glass substrate and a rear glass substrate which are opposed to each other with a predetermined gap therebetween. A plurality of pairs of row electrodes which are paired with each other and extended in parallel are formed on the inner surface (the side opposed to the rear glass substrate) of the foregoing front glass substrate, or a display surface, as pairs of sustain electrodes. A plurality of column electrodes are formed on the rear glass substrate as address electrodes so as to extend orthogonal to the pairs of row electrodes, and phosphors are further applied thereto. When viewed from the foregoing display-surface side, display cells corresponding to pixels are formed at intersections of the pairs of row electrodes and the column electrodes.

The plasma display panel is subjected to gradation driving based on a sub-field method for the sake of achieving halftone display luminance corresponding to an input video signal.

In the gradation driving based on the sub-field method, a display drive for a single field of a video signal is performed in a plurality of individual sub-fields to which respective intended numbers of times (or periods) of light emission are assigned. In each sub-field, an address stage and a sustain stage are performed in succession. At the address stage, selective discharge is generated between the row electrodes and the column electrodes of respective display cells selectively in accordance with the input video signal, thereby forming (or erasing) a predetermined amount of wall charge. At the sustain stage, sustain pulses are applied to each row electrode so that display cells having the predetermined amount of wall charge formed therein alone generate discharge repeatedly to sustain the light-emitting state resulting from the discharge. An initialization stage is also performed at least in the first sub-field, prior to the address stage. In the initialization stage, reset discharge is generated between the paired row electrodes in all the display cells, thereby initializing the amount of wall charge remaining in each display cell.

The reset discharge is comparatively strong and not involved in the content of an image to be displayed, so that light emission caused by the reset discharge lowers the image contrast.

In such a situation, a proposal has been made on a PDP and driving method for same that discharge delay is reduced by putting a magnesium oxide crystallization, that emits light of cathode-luminescence with a peak at a wavelength of 200-300 nm under the excitation of electron beam irradiation, over the surface of a dielectric layer covering the row electrode pairs (see Japanese Patent Laid-Open No. 2006-54160). According to the PDP, weak discharge can be caused stably because the post-discharge priming effect continues for a comparatively long time. Consequently, by applying to the PDP row electrodes a reset pulse having a pulse waveform whose voltage gradually reaches a peak value with the passage of time, weak reset discharge is caused between adjacent ones of the row electrodes. In this case, the image contrast can be improved because the luminance level of light emission given by the discharge is lowered by the weakening of reset discharge.

However, with such a driving scheme, there is a difficulty in fully enhancing so-called dark contrast in displaying a dark image, thus problematically making it impossible to provide a dark image in a quality state.

SUMMARY OF THE INVENTION

It is an object of the present invention to provide a plasma display panel driving method capable of enhancing representability with luminance gradations in displaying a dark image.

A plasma display panel driving method in the invention is a method for driving a plasma display panel in accordance with pixel data for each pixel based on a video signal, the plasma display panel having first and second substrates which are oppositely arranged sandwiching a discharge space in which discharge gas is filled, a plurality of row electrode pairs formed on the first substrate and each providing a scanning line, and a plurality of column electrode formed on the second substrate, in order to form display cells each including a phosphor layer at intersections of the row electrode pairs and the column electrodes, the method comprising the steps of: executing a reset stage for initializing the display cells in a beginning sub-field of a plurality of sub-fields into which a one-field display period of the video signal is divided; executing, in order, an address stage for setting the display cells in an ON mode or OFF mode by causing an address discharge selectively in the display cells in accordance with the pixel data in all of the plurality of sub-fields, and a sustain stage for causing a sustain discharge in each display cell set in the ON mode; and executing an erase stage for setting the OFF mode for all display cells which are in the ON mode-following the sustain stage of an end sub-field of the plurality of sub-fields, wherein, in the erase stage, a scanning pulse is sequentially applied to one row electrode of each of the row electrode pairs for each scanning line or for each scanning line group which is formed by a plurality of scanning lines, while an erase pulse is applied to the column electrodes simultaneously with the application of the scanning pulse, to cause an erase discharge between the one row electrode and each of the column electrodes to which the erase pulse is applied.

In the plasma display panel driving method according to the invention, the erase pulse is applied for each scanning line or for each scanning line group in the erase period of the last sub-field of a one-field display period, thus preventing a large current from flowing instantaneously and a pulse waveform from distorting. Thus, erase discharge is positively effected in the display cell holding an ON mode in the last sub-field. After terminating the erase stage of the last sub-field, all the display cells are placed in an OFF mode. This, accordingly, can improve the representability with luminance gradations in displaying a dark image.

BRIEF DESCRIPTION OF THE DRAWINGS

FIG. 6 is a diagram showing a light emission pattern for each gradation.

FIG. 13 is a figure showing a light emission pattern for each gradation in the light emission drive sequence of FIG. 12.

DETAILED DESCRIPTION OF THE INVENTION

Figure 1:
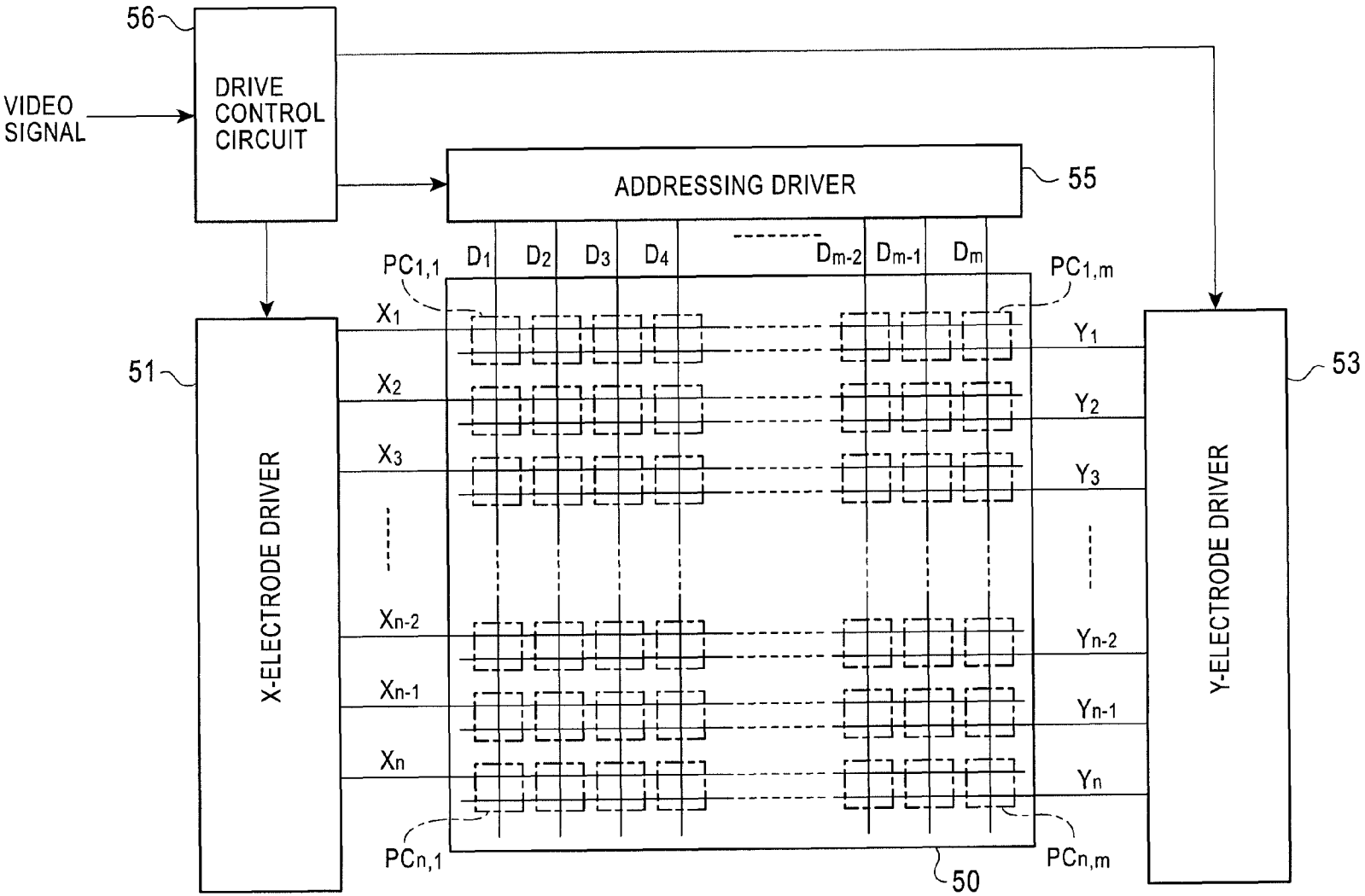
FIG. 1 is a diagram showing a schematic configuration of a plasma display apparatus to which the present invention is applied.

With referring to the drawings, explanation will be now made on embodiments according to the present invention.

FIG. 1 is a diagram showing a schematic configuration of a plasma display apparatus whose plasma display panel is driven using a drive scheme according to the present invention.

The plasma display apparatus comprises a plasma display panel or PDP 50, an X-electrode driver 51, a Y-electrode driver 53, an addressing driver 55 and a drive control circuit 56, as shown in FIG. 1.

In the PDP 50, column electrodes $D_1$ to $D_m$ are extended and arranged in the longitudinal direction (vertical direction) of a two-dimensional display screen, and row electrodes $X_1$ to $X_n$ and row electrodes $Y_1$ to $Y_n$ are extended and arranged in the lateral direction (the horizontal direction) thereof. The row electrodes $X_1$ to $X_n$ and row electrodes $Y_1$ to $Y_n$ form row electrodes pairs $(Y_1, X_1)$, $(Y_2, X_2)$, $(Y_3, X_3)$, . . . , $(Y_n, X_n)$ which are paired with those adjacent to each other and which serve as the first display line to the nth display line in the PDP 50. In each intersection part of the display lines with the column electrodes $D_1$ to $D_m$ (areas surrounded by dashed lies in FIG. 1), a display cell PC which serves as a pixel is formed. More specifically, in the PDP 50, the display cells $PC_{1,1}$ to $PC_{1,m}$ belonging to the first display line, the display cells $PC_{2,1}$ to $PC_{2,m}$ belonging to the second display line, and the display cells $PC_{n,1}$ to $PC_{n,m}$ belonging to the nth display line are each arranged in a matrix.

Figure 2:
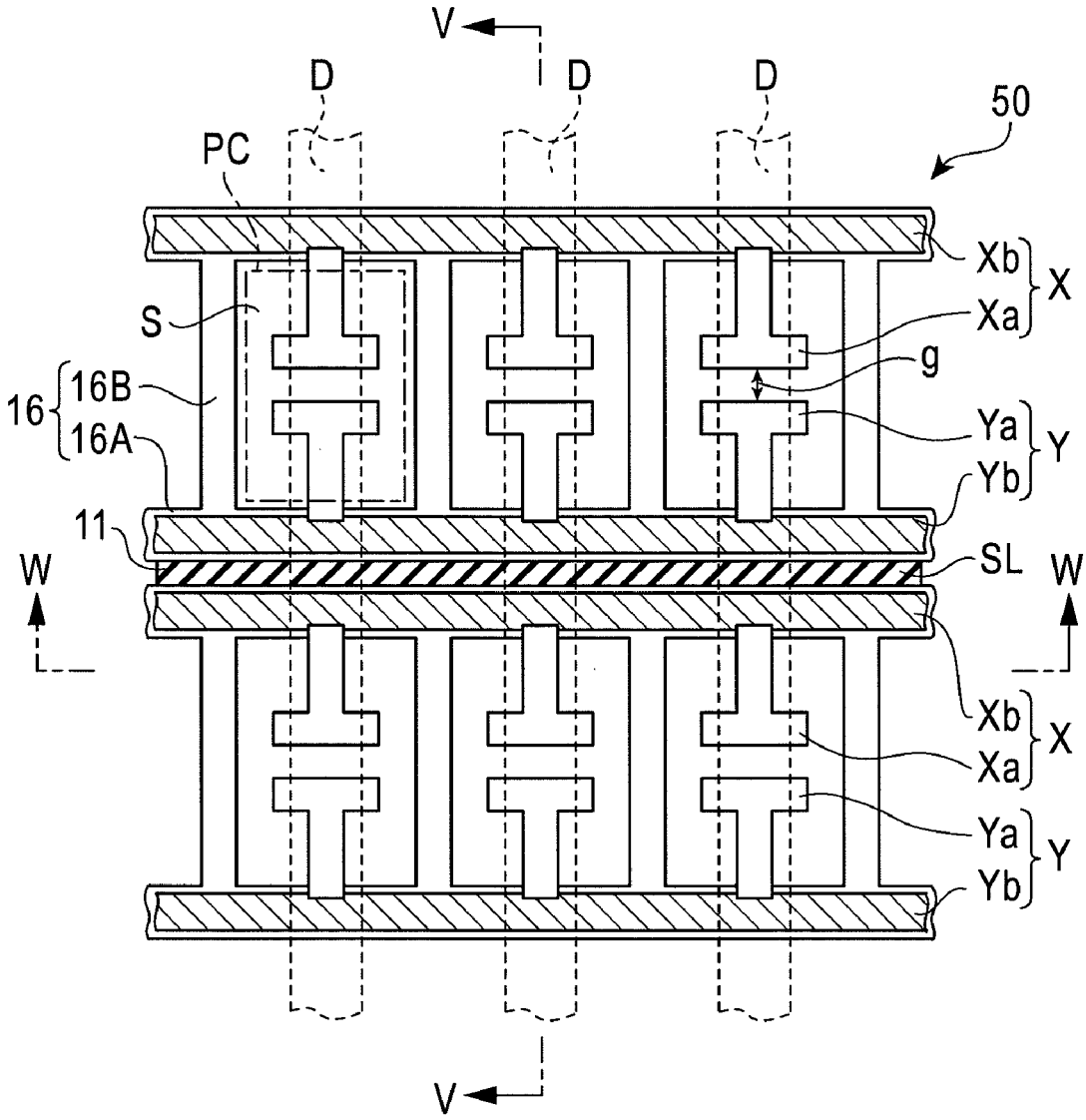
FIG. 2 is a front view typically showing an internal structure of the PDP in the apparatus of FIG. 1.
Figure 3:
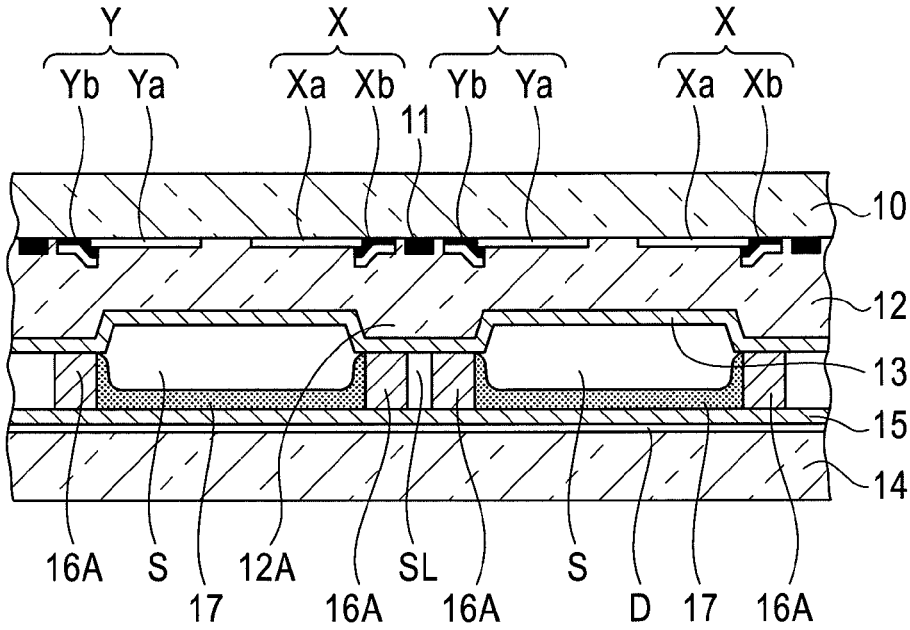
FIG. 3 is a diagram illustrating a cross section on line V-V shown in FIG. 2.
Figure 4:
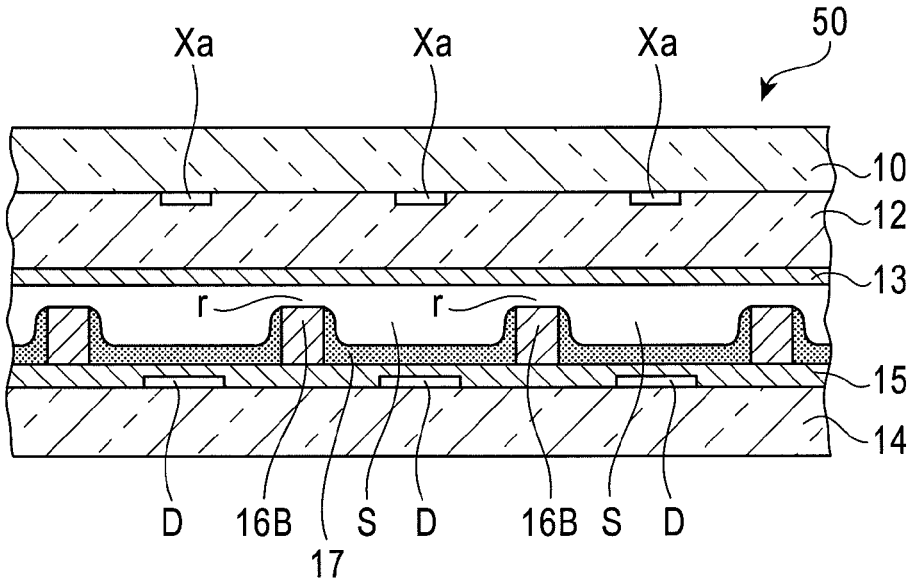
FIG. 4 is a diagram illustrating a cross section on line W-W shown in FIG. 2.

FIG. 2 is a front view typically showing the internal structure of the PDP 50 as viewed at from the screen. Note that FIG. 2 illustrates representatively the intersections of three column electrodes D that are adjacent mutually and two display lines that are adjacent mutually. FIG. 3 depicts a diagram illustrating a cross section of the PDP 50 at a line V-V in FIG. 2, and FIG. 4 depicts a diagram illustrating a cross section of the PDP 50 at a line W-W in FIG. 2.

As shown in FIG. 2, each row electrodes X has a bus electrode Xb extending horizontally of the two-dimensional display screen and a T-form transparent electrode Xa provided at a position contacting with the bus electrode Xb and corresponding to the display cell PC. Each row electrode Y is structured with a bus electrode Yb extending horizontally of the two-dimensional display screen and a T-form transparent electrode Ya provided at a position contacting with the bus electrode Yb and corresponding to the display cell PC. The transparent electrodes Xa, Ya are each formed by a transparent conductive film such as ITO while the bus electrodes Xb, Yb are each formed by a metal film, for example. The row electrodes X, each formed by the transparent electrode Xa and the bus electrode Xb, and the row electrodes Y, each formed by the transparent electrode Ya and the bus electrode Yb, are formed on a back surface of the front transparent substrate 10 providing a display surface of the PDP 50, as shown in FIG. 3. In this case, the transparent electrodes Xa and Ya in each row electrode pair (X, Y) are extended to the counterpart row electrode side to be paired, and have wide portions. The wide portions have respective tip sides opposed to each other through a discharge gap g1 having a predetermined width. On the backside of the front transparent substrate 10, a light absorbing layer (shade layer) 11 having black or dark color is formed extending horizontally of the two-dimensional display screen, between the adjacent ones of the row electrode pairs (X, Y). Furthermore, on the backside of the front transparent substrate 10, a dielectric layer 12 is formed so as to cover the row electrode pairs (X, Y). The dielectric layer 12 is formed, at its backside (in a surface opposite to the surface contacted with the row electrode pairs), with an increased dielectric layer portion 12A at a position corresponding to a region formed with the light absorbing layer 11 and the bus electrodes Xb, Yb adjacent to the light absorbing layer 11, as shown in FIG. 3.

A magnesium oxide layer 13 is formed on a surface of the dielectric layer 12 including the layer portion 12A. The magnesium oxide layer 13 contains a magnesium oxide crystal (hereinafter, referred to as CL-emission MgO crystallization) serving as a secondary-electron emission material to cause CL (cathode luminescence) emission having a peak at a wavelength of 200-300 nm, particularly 230-250 nm, when excited with the illumination of an electronic ray. The CL-emission MgO crystallization is obtainable by the vapor phase oxidation of a magnesium vapor produced by heating magnesium, which has a polycrystal structure that cubic crystals are compacted together or a cubic single-crystal structure, for example. The CL-emission MgO crystallization has a mean grain size of 2000 angstroms or greater (measurement result by the BET method).

In order to form a magnesium-oxide single crystal having the mean grain size as great as 2000 angstroms or greater by a vapor phase process, there is a need to increase the heating temperature for producing a magnesium vapor. This increases the flame length for causing magnesium and oxide to react. As the vapor-phase-oxidized magnesium single crystal increases in grain size with the increasing temperature difference between the flame and the surrounding, those can be formed greater in the number having an energy level corresponding to the peak wavelength (e.g. around 235 nm, within 230-250 nm) of CL emission as mentioned above.

The energy level corresponding to the CL-emission peak wavelength is provided for the vapor-phase-oxidized magnesium single crystal produced by reacting the greater quantity of oxygen through increasing the amount of magnesium to vaporize per unit time and increasing the reaction area of magnesium with oxygen, as compared to the usual vapor-phase oxidation.

By attaching the CL-emission MgO crystallization to the surface of the dielectric layer 12 by spraying, electrostatic application or so, the magnesium oxide layer 13 is formed. Alternatively, by forming a thin-film magnesium oxide layer on the surface of the dielectric layer 12 by evaporation or sputtering, CL-emission MgO crystallization may be attached thereto thereby forming the magnesium oxide layer 13.

On a back substrate 14 arranged parallel with the front transparent substrate 10, column electrodes D are formed extending orthogonally to the row electrode pairs (X, Y), in a position opposed to the transparent electrodes Xa, Ya of the row electrode pair (X, Y). Over the back substrate 14, a column-electrode protection layer 15 white in color is further formed covering the column electrodes D. Barriers 16 are formed on the column-electrode protection layer 15. The barrier 16 is formed in a ladder form with a transverse wall 16A extending transversely of the two-dimensional display screen and a longitudinal wall 16B extending lengthwise of the two-dimensional display screen intermediately between the adjacent column electrodes D, in a position corresponding to the bus electrodes Xb, Yb of the row electrode pair (X, Y). Furthermore, the ladder-formed barrier 16 as shown in FIG. 2 is formed on each of display lines of the PDP 50. Gaps SL exist between adjacent ones of the barriers 16, as shown in FIG. 2. By the ladder-like barrier 16, display cells PC each including a discharge space S and transparent electrodes Xa, Ya are zoned. The discharge space S fills therein a discharge gas containing a xenon gas. In the display cell PC, a phosphor layer 17 is formed over the side surface of the transverse wall 16A, the side surface of the longitudinal wall 16B and the surface of the column-electrode protection layer 15, in a manner covering the entire of those surfaces. The phosphor layer 17 practically includes three types, i.e. a phosphor for red emission, a phosphor for green emission and a phosphor for blue emission.

Figure 5:
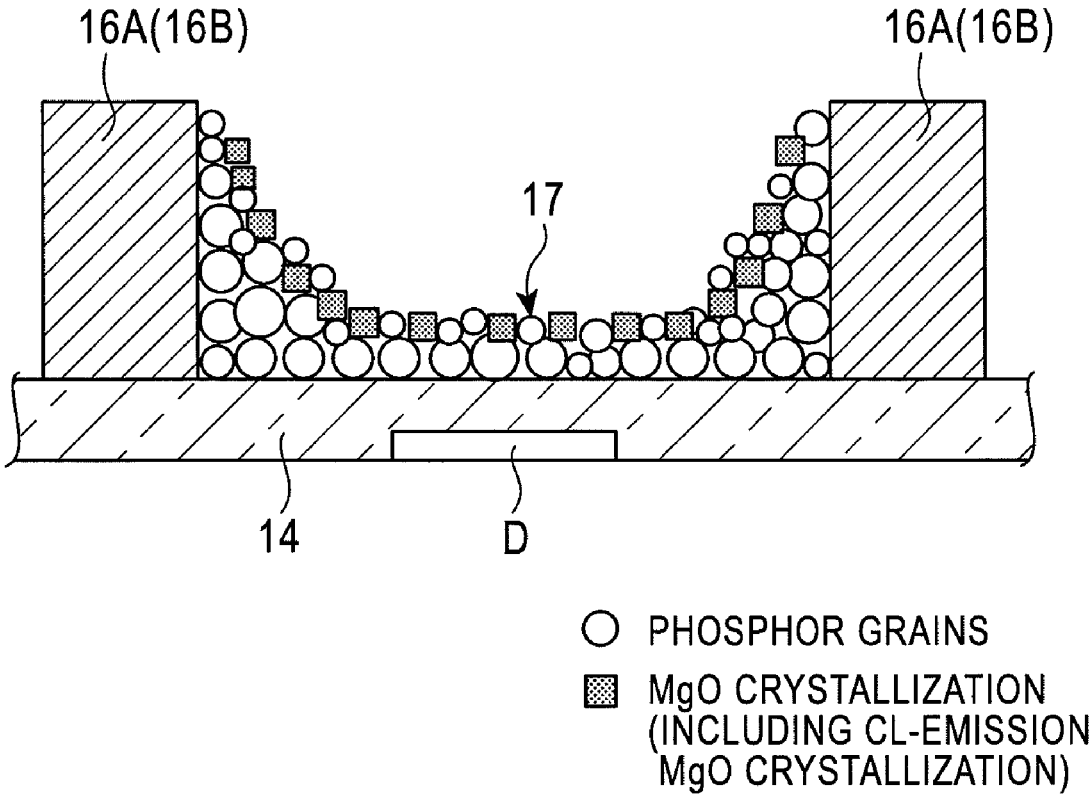
FIG. 5 is a view typically showing an MgO crystallization contained in a phosphor layer of each display cell of the PDP of FIG. 2.

Incidentally, the phosphor layer 17 contains an MgO crystallization (including a CL-emission MgO crystallization) as a secondary-electron emission material, in a form as shown in FIG. 5 for example. In this case, the MgO crystallization is exposed from the phosphor layer 17 in a manner contacting with a discharge gas, at least in the surface of the phosphor layer 17, i.e. the surface contacting with the discharge space S.

Here, the discharge space S of the display cell PC and the gap SL are closed from each other by providing the magnesium oxide layer 13 in contact with the transverse wall 16A, as shown in FIG. 3. Further, because the longitudinal wall 16B is not in contact with the magnesium oxide layer 13 as shown in FIG. 4, a gap "r" exists between those. Namely, the display cells PCs, adjacent transversely of the two-dimensional display screen, have respective discharge spaces S communicating with each other through the gap "r".

The drive control circuit 56 first converts the input video signal into 8-bit pixel data which expresses its luminance levels in 256 tone levels pixel by pixel, and performs multi-gradation processing consisting of error diffusion processing and dither processing to the pixel data. Namely, firstly, in the error diffusion processing, the high-order six bits of the pixel data are taken as display data while the remaining low-order two bits are as error data. By reflecting the display data with the weighted addition of the error data concerning the pixel data corresponding to surrounding pixels, 6-bit error-diffusion pixel data is obtained. With such error diffusion, the low-order two bits of luminance on one pixel is synthetically represented by pixels surrounding the one pixel. Therefore, gray-scale representation is available equivalently to 8-bit pixel data, by means of 6-bit display data smaller than 6-bit one. Then, the drive control circuit 56 performs dithering on the error-diffused pixel data obtained by the 6-bit error diffusion. In dithering, by taking a plurality of mutually adjacent pixels as one pixel unit, dither coefficients different one from another are assigned and added to the respective ones of error-diffused pixel data corresponding to the pixels of one pixel unit, thereby obtaining dither-added pixel data. With such addition of dither coefficients, gradation representation is available correspondingly to 8 bits by use of only the high-order four bits of the dither-added pixel data. For this reason, the drive control circuit 56 converts the high-order four bits of the dither-added pixel data into 4-bit multi-gradation pixel data PD, that every luminance level is to be represented with 15 levels, as shown in FIG. 6. The drive control circuit 56 converts the mult-gradation pixel data PD, into 14-bit pixel drive data GD according to a data conversion table as shown in FIG. 6. The drive control circuit 56 puts the first to 14-th bits of the pixel drive data GD respectively corresponding to sub-fields SF1-SF14 (referred later) and supplies the bit digits corresponding to the sub-field SF, as pixel drive data bit, in an amount of one display line (m in the number) per time to the address driver 55.

Figure 7:
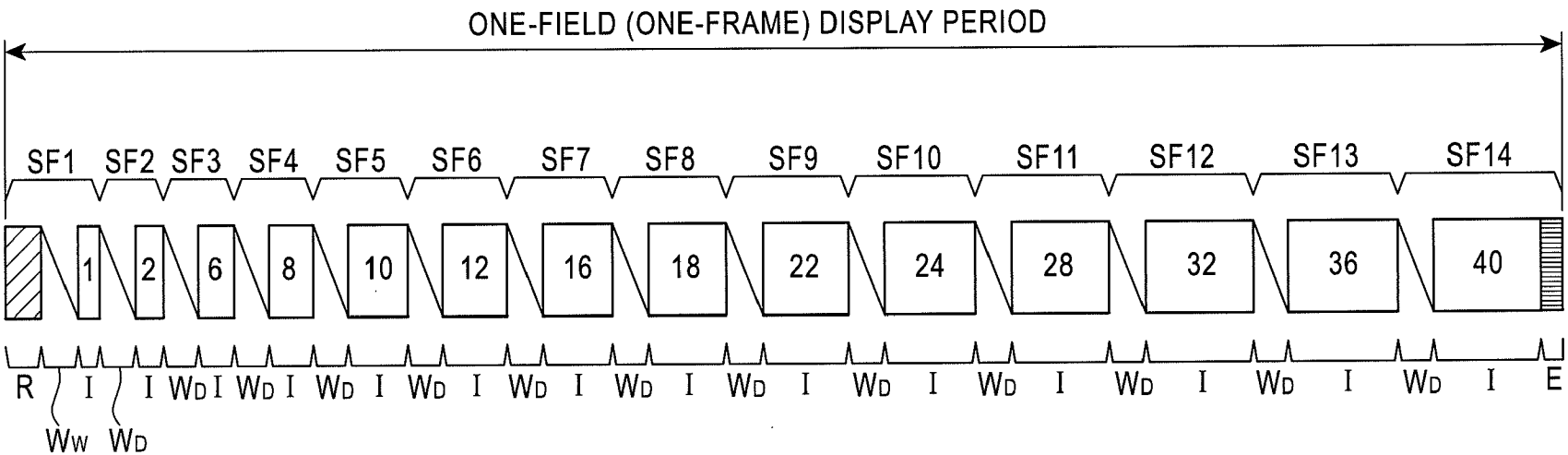
FIG. 7 is a diagram showing an example of a light emission drive sequence employing a selective erase method as a light emission driving scheme on the apparatus of FIG. 1.

Furthermore, the drive control circuit 56 supplies various control signals for driving the PDP 50 configured as above to a panel driver, formed by the X-electrode driver 51, the Y-electrode driver 53 and the address driver 55, according to an emission-drive sequence as shown in FIG. 7. Namely, in the beginning sub-field SF1 of a one-field (one-frame) display period as shown in FIG. 7, the drive control circuit 56 supplies the panel driver with various control signals for sequentially executing driving according to a reset stage R, a selective write-address stage $W_w$ and a sustain (discharge maintaining) stage I. In each of the sub-fields SF2-SF14, the panel driver is supplied with various control signals to sequentially execute driving according to a selective erase-address stage $W_D$ and a sustain stage I. Limitedly in the last sub-field SF14 within the one-field display period, the drive control circuit 56 after executed the sustain stage I supplies various control signals to the panel driver to sequentially execute driving according to an erase stage E.

Figure 8:
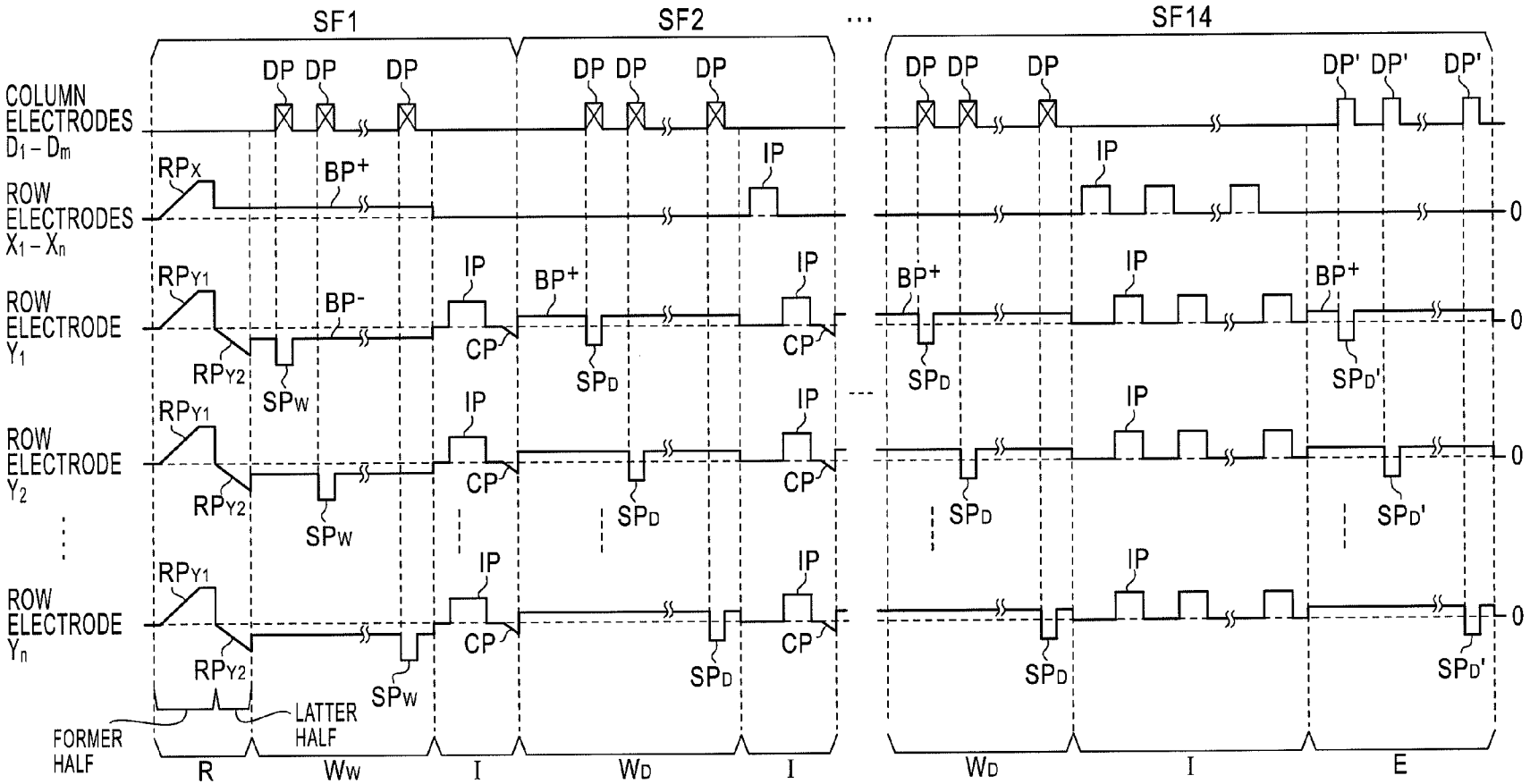
FIG. 8 is a diagram showing various drive pulses to be applied to the PDP according to the light emission drive sequence of FIG. 7.

The panel driver, i.e. X-electrode driver 51, Y-electrode driver 53 and address driver 55, generates various drive pulses as shown in FIG. 8 in accordance with the control signals supplied from the drive control circuit 56 and supplies those to the column D and row electrodes X, Y of the PDP 50.

FIG. 8 representatively shows only the operations in the beginning sub-field SF1, the succeeding sub-field SF2 and the last sub-field SF14, out of the sub-fields SF1-SF14 shown in FIG. 7.

At first, in the former half of the reset stage R of the sub-field SF1, the Y-electrode driver 53 applies to all the row electrodes $Y_1$-$Y_n$ a positive reset pulse $RP_{Y1}$ having a waveform moderate in potential transition at the leading edge with respect to the passage of time as compared to that of a sustain pulse, referred later. The reset pulse $RP_{Y1}$ has a peak potential higher than the peak potential of the sustain pulse. In this duration, the address driver 55 sets the column electrodes $D_1$-$D_m$ at a ground potential (0 volt) In response to the application of the reset pulse $RP_{Y1}$, first reset discharge takes place between the row electrode Y and the column electrode D in each of all the display cells PC. Namely, in the former half of the reset stage R, applying a voltage between the both electrodes such that the row electrode Y is on the anode side and the column electrode D on the cathode side, discharge is caused as a first reset discharge to flow a current from the row electrode Y to the column electrode D (hereinafter, referred to as cathode-at-column discharge). In response to the first reset discharge, negative wall charges are formed nearby the row electrode Y in each of all the display cells PCs while positive wall charges are nearby the column electrode D.

In the former half of the reset stage R, the X-electrode driver 51 applies to all the row electrodes $X_1$-$X_n$ a reset pulse $RP_x$ same in polarity as the reset pulse $RP_{Y1}$ and having a peak potential capable of preventing a discharge from occurring between the row electrodes X and Y due to the application of the reset pulse $RP_{Y1}$.

In the latter half of the reset stage R of the sub-field SF1, the Y-electrode driver 53 generates a negative reset pulse $RP_{Y2}$ that is moderate in potential transition at the leading edge with respect to the passage of time and applies it to all the row electrodes $Y_1$-$Y_n$. Furthermore, in the latter half of the reset stage R, the X-electrode driver 51 applies a positive base pulse $BP^+$ having a predetermined base potential to all the row electrodes $X_1$-$X_n$. On this occasion, second reset discharge is caused between the row electrodes X and Y in all the display cells PCs by the application of the negative reset pulse $RP_{Y2}$ and positive base pulse $BP^+$. The reset pulse $RP_{Y2}$ and the base pulse $BP^+$ each have a peak potential provided minimally to positively cause a second reset discharge between the row electrodes X and Y in consideration of the wall charges formed nearby the row electrodes X and Y in response to the first reset discharge. The reset pulse $RP_{Y2}$ is set with a negative peak potential higher in value than the peak potential of the negative write scanning pulse $SP_w$ referred later, i.e. at a potential approximate to 0 volt. Namely, this is because, if providing the peak potential of the reset pulse $RP_{Y2}$ lower than the peak potential of the write scanning pulse $SP_w$, strong discharge results between the row electrode Y and the column electrode D to thereby significantly erase the wall charges formed nearby the column electrode D and hence make unstable the address discharge in the selective write-address stage $W_w$. By the second reset discharge caused in the latter half of the reset stage R, erased are the wall charges that have been formed nearby the row electrodes X, Y in each of the display cells PCs, thus initializing all the display cells PCs in the OFF mode. Furthermore, in response to the application of the reset pulse $RP_{Y2}$, weak discharge is also caused between the row electrode Y and the column electrode D in all the display cells PCs. Due to the discharge, the positive wall charges formed nearby the column electrode D are partly erased away thus being regulated into the amount that selective write-address discharge is to be caused correctly in the selective write-address stage $W_w$.

In the selective write-address stage $W_w$ of the sub-field SF1, the Y-electrode driver 53 applies a write scanning pulse $SP_w$ having a negative peak potential selectively, in order, to the row electrodes $Y_1$-$Y_n$ while simultaneously applying to the row electrodes $Y_1$-$Y_n$ a negative base pulse $BP^-$ having a predetermined base potential as shown in FIG. 8. The X-electrode driver 51, in the selective write-address stage $W_w$, continuously applies to the row electrodes $X_1$-$X_n$ the base pulse $BP^+$ applied to the row electrodes $X_1$-$X_n$ in the latter half of the reset stage R. Incidentally, the base pulses $BP^-$, $BP^+$ have respective potentials set at such a potential that the voltage between the row electrodes X and Y, in the non-application period of the write scanning pulse $SP_w$, is lower than a discharge start voltage at the display cell PC.

In the selective write-address stage $W_w$, the address driver 55 converts the pixel-drive data bit corresponding to the sub-field SF1 into a pixel data pulse DP having a pulse voltage commensurate with the logic level thereof. For example, when supplied with pixel-drive data bit having a logic level 1 to set the display cell PC in the ON mode, the address driver 55 converts it into a pixel-data pulse DP having a positive peak potential. On the other hand, for pixel-drive data bit having a logic level 0 to set the display cell PC in the OFF mode, it is converted into a pixel-data pulse DP having a low voltage (0 volt). The address driver 55 applies such pixel-data pulses DP in an amount of one display line (m in the number) per time to the column electrodes $D_1$-$D_m$ synchronously with the application timing of the write scanning pulses $SP_w$. On this occasion, simultaneously with the write scanning pulse $SP_w$, selective write-address discharge is caused between the column electrode D and the row electrode Y in the display cell PC to which a high-voltage pixel data pulse DP has been applied for setting into the ON mode. Immediately after the selective write-address discharge, weak discharge is also caused between the row electrodes X and Y of the relevant display cell PC. Namely, although a voltage commensurate with the base pulse $BP^-$ or $BP^+$ is applied between the row electrodes X and Y after the application of the write scanning pulse $SP_w$, the relevant voltage is set at a value lower than the discharge start voltage at the display cells PCs so that discharge is not to be caused in the display cell PC by only the application of that voltage. Nevertheless, when selective write-address discharge is caused, discharge arises between the row electrodes X and Y by the sole application of the voltage based on a base pulse $BP^-$, $BP^+$ due to the inducement of the selective write-address discharge. By such discharge together with the selective write-address discharge, the display cell PC is set in a state that positive wall charges are formed nearby the row electrode Y, negative wall charges are formed nearby the row electrode X and negative wall charges are formed nearby the column electrode D, i.e. in the ON mode. On the other hand, selective write-address discharge, like the above, is not caused between the column electrode D and the row electrode Y in the display cell PC to which applied are a pixel data pulse DP having a low voltage (0 volt) for setting into the OFF mode simultaneously with the write scanning pulse $SP_w$, hence not causing a discharge between the row electrodes X and Y. Accordingly, the display cell remains in its state, i.e. in the OFF mode that initialization is made in the reset stage R.

In the sustain stage I of the sub-field SF1, the Y-electrode driver 53 generates a sustain pulse IP having positive peak potential in an amount of one pulse and applies it simultaneously to the row electrodes $Y_1$-$Y_n$. In this duration, the X-electrode driver 51 sets the row electrodes $X_1$-$X_n$ at a ground potential (0 volt) while the address driver 55 sets the column electrodes $D_1$-$D_m$ at a ground potential (0 volt). In response to the application of the sustain pulse IP, sustain discharge is caused between the row electrodes X and Y in the display cell PC being set in the ON mode. Due to the sustain discharge, the phosphor layer 17 gives off light toward the outside through the front transparent substrate 10, thus effecting once emission of display light correspondingly to the weight of luminance for the sub-field SF1. In response to the application of the sustain pulse IP, discharge is also caused between the row electrode Y and the column electrode D in the display cell PC being set in the ON mode. By such discharge together with the sustain discharge, negative wall charges are formed nearby the row electrode Y in the display cell PC while positive wall charges are formed nearby the row electrode X and the column electrode D. After the application of the sustain pulse IP, the Y-electrode driver 53 applies to the row electrodes $Y_1$-$Y_n$ a wall-charge adjust pulse CP that is moderate in potential transition at the leading edge with respect to the passage of time and having a negative peak potential, as shown in FIG. 8. In response to the application of the wall-charge adjust pulse CP, weak erase discharge is caused in the display cell PC where sustain discharge is caused, thereby erasing away part of the wall charges formed at the inside thereof. This adjusts the wall charges of the display cell PC into such an amount that can correctly cause selective erase-address discharge in the next selective erase-address stage $W_D$.

In the selective erase-address stage $W_D$ in each of the sub-fields SF2-SF14, the Y-electrode driver 53 applies an erase scanning pulse $SP_D$ having a negative peak potential as shown in FIG. 8 selectively, in order, to the row electrodes $Y_1$-$Y_n$ while applying a positive base pulse $BP^+$ having a predetermined base potential to the row electrodes $Y_1$-$Y_n$. The peak potential of the base pulse $BP^+$ is set at a potential for preventing an erroneous discharge from occurring between the row electrodes X and Y during execution of the selective erase-address stage $W_D$. During execution of the selective erase-address stage $W_D$, the X-electrode driver 51 sets the row electrodes $X_1$-$X_n$ at a ground potential (0 volt).

In the selective erase-address stage $W_D$, the address driver 55 first converts the pixel-drive data bit corresponding to the relevant sub-field SF into a pixel-data pulse DP having a pulse voltage commensurate with the logic level thereof. For example, when supplied with pixel-drive data bit having a logic level 1 for transiting the display cell PC from ON to OFF mode, the address driver 55 converts it into a pixel-data pulse DP having a positive peak potential. When supplied with pixel-drive data bit having a logic level 0 for maintaining the display cell PC in its current status, it is converted into a pixel-data pulse DP having a low voltage (0 volt). The address driver 55 applies the pixel-data pulse DP in an amount of one display line (m in the number) per time, in order, to the column electrodes $D_1$-$D_m$ synchronously with the application timing of the erase scanning pulse $SP_D$. On this occasion, selective erase-address discharge is caused between the column electrode D and the row electrode Y in the display cell PC to which the pixel-data pulse DP is applied simultaneously with the erase scanning pulse $SP_D$. By the selective erase-address discharge, the relevant display cell PC is set in a state that positive wall charges are formed nearby the row electrodes Y and X while negative wall charges are nearby the column electrode D, i.e. in the OFF mode. On the other hand, such selective erase-address discharge is not caused between the column electrode D and the row electrode Y in the display cell PC to which a low-voltage (0 volt) pixel data pulse DP is applied simultaneously with the erase scanning pulse $SP_D$. Accordingly, the relevant display cell PC remains in its state (in the ON mode or in the OFF mode).

In the sustain stage I of each of the sub-fields SF2-SF14, the X-electrode and Y-electrode drivers 51, 53 apply sustain pulses IP having a positive peak potential alternately to the row electrodes $X_1$-$X_n$ and $Y_1$-$Y_n$, repeatedly in the (even) number of times corresponding to the weighting of luminance for the relevant sub-field, as shown in FIG. 8. Each time the sustain pulse IP is applied, sustain discharge is caused between the row electrodes X and Y in the display cell PC being set in the ON mode. Due to the sustain discharge, the light given off from the phosphor layer 17 is emitted to the outside through the front transparent substrate 10, thus effecting emissions of display light in the number of times corresponding to the weighting of luminance for the relevant sub-field SF. On this occasion, in the sustain stage I of each of the sub-fields SF2-SF14, wall charges are formed negative nearby the row electrode Y and positive nearby the row and column electrodes X, D in the display cell PC where sustain discharge is caused in accordance with the last applied sustain pulse IP. After the application of the last sustain pulse IP, the Y-electrode driver 53 applies to the row electrodes $Y_1$-$Y_n$ a wall-charge adjust pulse CP having a negative peak potential moderate in potential transition at the leading edge with respect to the passage of time, as shown in FIG. 8. In response to the application of the wall-charge adjust pulse CP, weak erase discharge is caused in each display cell PC where sustain discharge is caused as in the above, thus erasing away part of the wall charges formed therein. Due to this, the wall charges in the display cell PC are adjusted into an amount that selective erase-address discharge is to be correctly caused in the next selective erase-address stage $W_D$.

In the last erase stage E of the last sub-field SF14, the Y-electrode driver 53 applies an erase scanning pulse SPD' having a negative peak potential as shown in FIG. 8 selectively, in order, to the row electrode $Y_1$-$Y_n$ while applying to the row electrodes $Y_1$-$Y_n$ a positive base pulse $BP^+$ having a predetermined base potential. The base pulse $BP^+$, during execution of the erase stage E, is set with a peak potential at a value capable of preventing an erroneous discharge from occurring between the row electrodes X and Y. During execution of the erase stage E, the X-electrode driver 51 sets the row electrodes $X_1$-$X_n$ at a ground potential (0 volt).

In the erase stage E, the address driver 55 applies an address pulse DP' having a positive peak potential, as a erase pulse, in an amount of one display line (m in the number) per time to the column electrodes $D_1$-$D_m$ synchronously with the application timing of the erase scanning pulse $SP_D$' in order to put all the display cells PCs in erase mode, similarly to the case of supplying the pixel-drive data bit having a logic level 1. On this occasion, erase discharge is caused between the column electrode D and the row electrode Y, in all the display cells PCs that the address pulse DP' is applied simultaneously with the erase scanning pulse $SP_D$ and staying in the ON mode. By the erase discharge, the display cell PC staying in the ON mode is set into a state that wall charges are formed positive nearby the row electrodes X, Y and negative nearby the column electrode D, i.e. in the OFF mode. In the display cell PC that have been placed in the OFF mode at or before the sub-field SF13, the OFF mode is maintained. This places all the display cells PCs in the OFF mode.

Such driving is executed based on fifteen patterns of pixel-drive data GD as shown in FIG. 6. With such driving, write-address discharge is first caused (shown with a double circle) in each display cell PC in the beginning sub-field SF1 excepting the case to represent a luminance level 0 (first gradation level), thus setting the display cell PC in the ON mode as shown in FIG. 6. Thereafter, selective erase-address discharge is caused (shown with a black circle) only in a selective erase-address stage $W_0$ in one of the sub-fields SF2-SF14, followed by placing the display cell PC in the OFF mode. Namely, the display cell PC is placed in the ON mode in the sub-fields continuing correspondingly to a halftone level to represent wherein light emission is caused by sustain discharge (shown with a white circle) repeatedly by the number of times assigned to each of the sub-fields. On this occasion, the luminance to be perceived is in proportion to the total number of sustain discharges caused within the one-field (one-frame) display period. For this reason, with fifteen patterns of light emission based on the first to 15-th gradation drive levels, gradations of fifteen levels are represented correspondingly to the total number of sustain discharges to be caused in the sub-fields shown at white circles.

With such driving, there are no light-emission-pattern (ON, OFF state) inverted regions coexistent on one screen within the one-field display period. Thus, false contour is prevented from occurring in such a state.

Here, in the FIG. 8 driving, a voltage is applied between the both electrodes such that the row electrode Y is on the anode side and the column electrode D on the cathode side, in the reset stage R of the beginning sub-field SF1. Due to this, cathode-at-column discharge is caused, as first reset discharge, to flow a current from the row electrode Y to the column electrode D. In such first reset discharge, the positive ion in the discharge gas, when moving toward the column electrode D, bombards against the MgO crystallization, i.e. secondary-electron emission material, contained in the phosphor layer 17 as shown in FIG. 5, thereby causing a secondary electron to emit from the MgO crystallization. Particularly, in the PDP 50 of the FIG. 1 plasma display, exposing the MgO crystallization in the discharge space as shown in FIG. 5 enhances the probability of bombardment against a positive ion, thus causing a secondary electron to emit into the discharge space with efficiency. By doing so, the discharge start voltage at the display cell PC is lowered by the priming action of the secondary electron, thus making it possible to cause a reset discharge comparatively weak. Weakening the rest discharge lowers the luminance of light emission as caused by the discharge, thus making it possible to make a display with improved dark contrast.

In the driving scheme shown in FIG. 8, first reset discharge is caused between the row electrode Y formed on the front transparent substrate 10 as shown in FIG. 3 and the column electrode D formed on the back electrode 14. Accordingly, dark contrast can be further improved because there is reduced the discharge light released to the outside through the front transparent substrate 10 as compared to the case to cause reset discharge between the row electrodes X and Y both formed on the front transparent substrate 10.

In the driving scheme shown in FIGS. 7 and 8, after reset discharge is first caused to initialize all the display cells PCs in the OFF mode in the beginning sub-field SF1, selective write-address discharge is caused to transit the display cells PCs being OFF into the ON mode. Thus, driving is implemented by employing the selective erase-address scheme for causing a selective erase-address discharge to transit the display cell PC being ON into the OFF mode, in one of the sub-fields SF2-SF14 following the sub-field SF1. In the case that black display (luminance level 0) is made based on such driving, it is only the reset discharge at the beginning sub-field SF1 that is to be caused throughout the one-field display period. Namely, as compared to the case that driving is executed to cause a selective erase-address discharge that all the display cell PCs are initialized into the ON mode in the beginning sub-fields SF1 and then transited into the OFF mode, the discharges to cause are reduced in the number within the one-field display period. Therefore, the driving shown in FIGS. 7 and 8 improves the contrast in dark image display, i.e. so-called dark contrast.

In the driving scheme shown in FIG. 8, sustain discharge is caused once in the sustain stage I of the sub-field SF1 having the smallest weighting of luminance, thus enhancing the reproducibility of display at a low luminance level for low gradation representation. In the sustain stage I of the sub-field SF1, only one sustain pulse IP is applied to cause sustain discharge. Accordingly, after terminating the sustain discharge caused in response to the one sustain pulse IP, there becomes a state that wall charges are formed negative nearby the row electrode Y and positive nearby the column electrode D. Due to this, in the selective erase-address stage $W_D$ of the next sub-field SF2, discharge can be caused as selective erase-address discharge between the column electrode D and the row electrode Y wherein the column electrode D is rendered as an anode (hereinafter, referred to as anode-at-column discharge). In the sustain stage I of each of the following sub-fields SF2-SF14, the applications of the sustain pulse IP are taken as an odd in the number of times. Accordingly, because there becomes a state that wall charges are formed negative nearby the row electrode Y and positive nearby the column electrode D immediately after terminating the sustain stage I, anode-at-column discharge is available in the selective erase-address stage $W_D$ to execute following the sustain stage I. Accordingly, the column electrode D is merely applied with a positive pulse, to prevent the cost increase of the address driver 55. In the PDP 50 shown in FIG. 1, CL-emission MgO crystallization is contained as a secondary-electron emission material not only in the magnesium oxide layer 13 formed on the front transparent substrate 10 of each display cell PC but also in the phosphor layer 17 formed on the back substrate 14 thereof.

Figure 9:
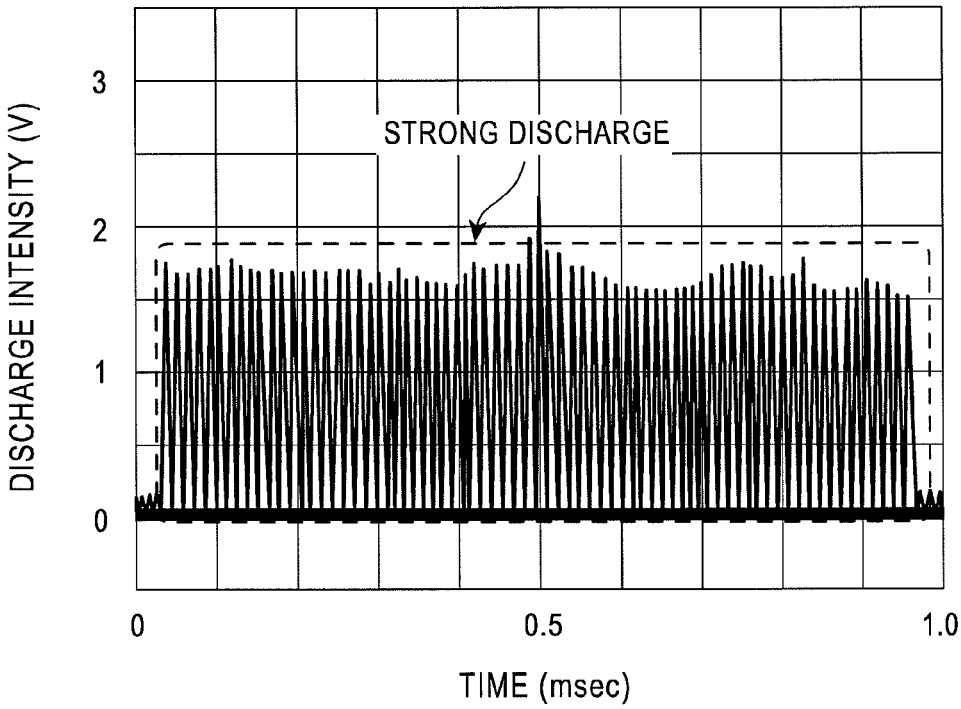
FIG. 9 is a figure showing transition of intensity of a cathode-at-column discharge caused upon applying a reset pulse to a conventional PDP.
Figure 10:
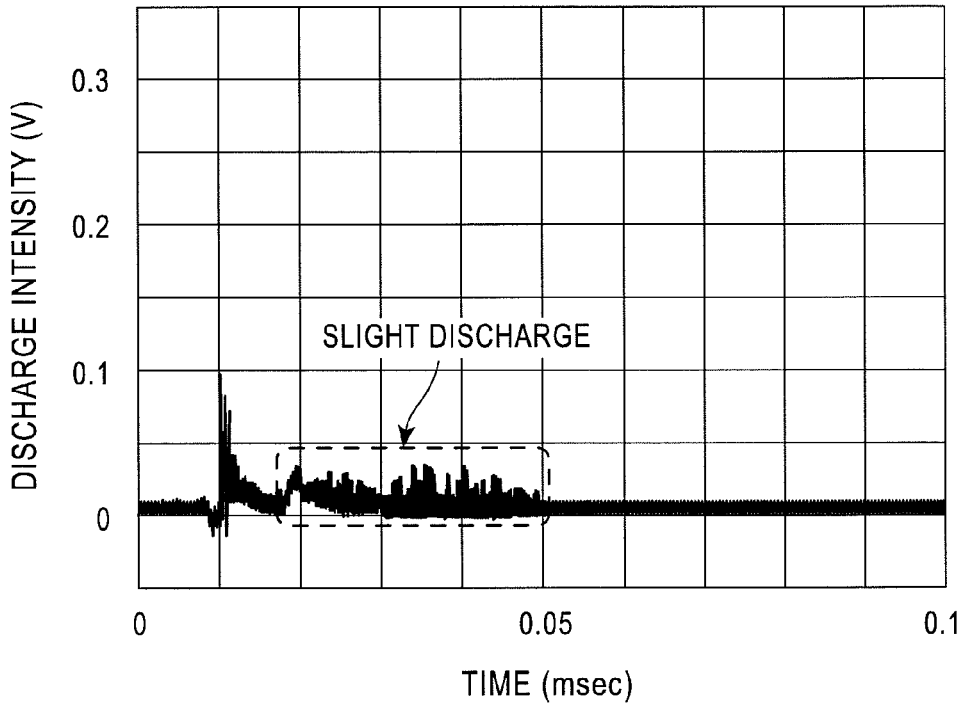
FIG. 10 is a figure showing transition of intensity of a cathode-at-column discharge caused upon applying a reset pulse to a PDP having the structure of FIG. 5.

Referring to FIGS. 9 and 10, explanation is made on the operation and effect of employing such a structure.

FIG. 9 is a figure showing an intensity transition of a cathode-at-column discharge as caused upon applying a reset pulse $RP_{Y1}$ as shown in FIG. 8 to the existing PDP containing CL-emission MgO crystallization only in the magnesium oxide layer 13 out of the magnesium oxide layer 13 and the phosphor layer 17 as in the foregoing.

On the other hand, FIG. 10 is a figure showing an intensity transition of a cathode-at-column discharge as caused upon applying a reset pulse $RP_{Y1}$ to the PDP, according to the invention, containing CL-emission MgO crystallization in both the magnesium oxide layer 13 and the phosphor layer 17.

As shown in FIG. 9, according to the existing PDP, cathode-at-column discharge, which is comparatively strong, continues for 1 [ms] or over upon the application of the reset pulse $RP_{Y1}$. However, according to the PDP 50 of the invention, cathode-at-column discharge terminates in approximately 0.04 [ms] as shown in FIG. 10. Namely, delay time can be greatly reduced as to cathode-at-column discharge, as compared to that of the existing PDP.

Accordingly, in case cathode-at-column discharge is caused by applying, to the Y-electrode of the PDP 50, a reset pulse $RP_{Y1}$ having a waveform moderate in potential transition at a rise section as in FIG. 8, the discharge terminates before the reset pulse $RP_{Y1}$ reaches its peak potential. Accordingly, because the cathode-at-column discharge terminates while yet low is the voltage being applied between the row electrode and the column electrode, the intensity thereof is significantly lower than that of FIG. 9, as shown in FIG. 10.

Namely, in the embodiment, cathode-at-column discharge having a weak intensity is caused by applying a reset pulse $RP_{Y1}$, say, as shown in FIG. 8 having a waveform moderate in potential transition at the rise thereof to the PDP 50 containing CL-emission MgO crystallization not only in the magnesium oxide layer 13 but also in the phosphor layer 17. Because such a cathode-at-column discharge extremely weak in intensity can be caused as a rest discharge, it is possible to enhance the image contrast, particularly the dark contrast in dark-image display.

There is an effect that discharge probability is improved by the priming-particle release action from the secondary-electron emission material, particularly the CL-emission MgO material, of the phosphor layer 17. In the erase stage E, an erase pulse is simultaneously applied to all the display cells PCs, discharge occurs nearly simultaneously between the row electrode Y and the column electrode D in all the display cells PCs being in the ON mode. In such a case, because discharge occurs nearly simultaneously in a number of display cells PCs, a large current flows instantaneously. The large current distorts the waveform of the erase pulse with a result of a weakened erase discharge. In such a case, there possibly occur a display cell PC not to completely become an erase mode in respect of the wall charges. For such a disadvantage, by employing a structure that erasure is sequentially on a scanning-line-by-scanning-line basis (for each scanning line) as in the FIG. 8 structure, there is eliminated an instantaneous flow of a large current, thus enabling to implement a stable erase discharge. Therefore, in the erase stage E, all the display cells PCs can positively be set in the OFF mode.

Figure 11:
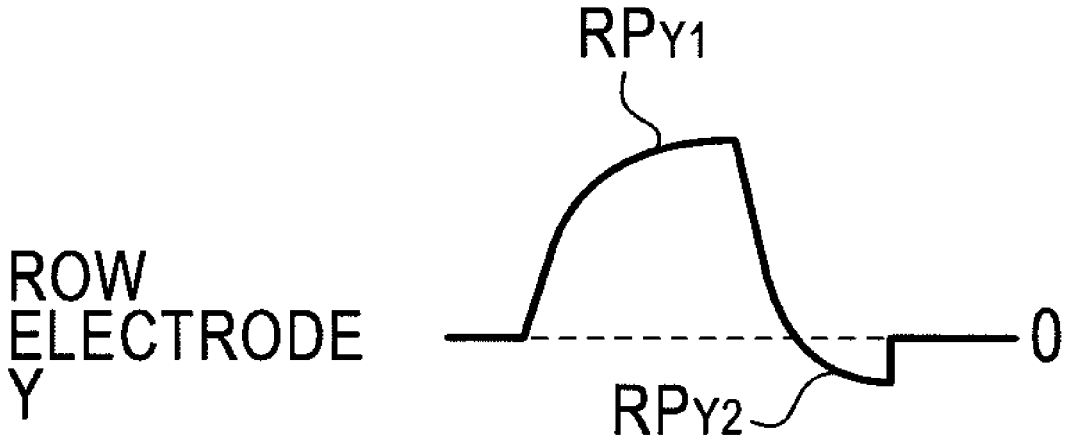
FIG. 11 is a figure showing another waveform of the reset pulse.

As for the waveform at a rise of the rest pulse $RP_{Y1}$ to be applied to the row electrode Y in order to cause a reset discharge as a cathode-at column discharge, the inclination may gradually change with the passage of time, say, as shown in FIG. 11 without limited to those having a constant inclination as shown in FIG. 8.

Figure 12:
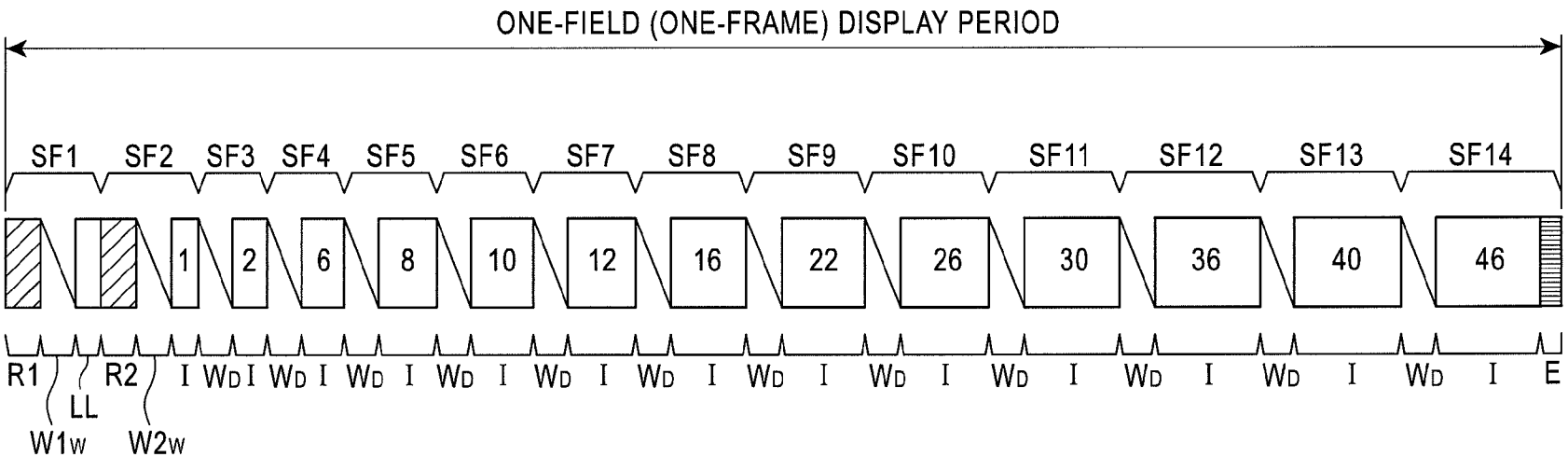
FIG. 12 is a figure showing another example of a light emission drive sequence employing a selective write-address method as an emission driving scheme on the apparatus of FIG. 1.

FIG. 12 shows another emission drive sequence employing a selective erase-address scheme to drive the PDP 50. The drive control circuit 56 supplies various control signals, for driving the PDP 50 structured shown in FIG. 1, to the panel driver formed by the X-electrode driver 51, the Y-electrode driver 53 and the address driver 55, according to an emission drive sequence shown in FIG. 12. In the beginning sub-field SF1 of a one-field (one-frame) display period as shown in FIG. 12, the drive control circuit 56 supplies the panel driver with various control signals to sequentially execute driving according to a first reset stage R1, a first selective write-address stage $W1_w$ and a slight-emission stage LL. In SF2 following the sub-field SF1, the panel driver is supplied with various control signals to sequentially execute driving according to a second reset stage R2, a second selective write-address stage $W2_w$ and a sustain stage I. In each of the sub-fields SF3-SF14, the panel driver is supplied with various control signals to sequentially execute driving according to a selective erase-address stage $W_D$ and a sustain stage I. Incidentally, limitedly to the last sub-field SF14 of the one-field display period, the drive control circuit 56 after executed the sustain stage I supplies the panel driver with various control signals in order to sequentially execute driving according to an erase stage E.

The drive control circuit 56 converts the high-order four bits of the dither-added pixel data, obtained in the dithering, into 4-bit mult-gradation pixel data $PD_S$ representing every luminance with 16 levels as shown in FIG. 13. The drive control circuit 56 converts the mult-gradation pixel data $PD_S$ into 14-bit pixel drive data GD according to the data conversion table as shown in FIG. 13. By placing the first to 14-th bits of the pixel drive data GD corresponding respectively to the sub-fields SF1-SF14, the address driver 55 is supplied with the bit digit corresponding to the sub-field SF in an amount of one display line (m in the number) per time, as pixel drive data bit.

Figure 14:
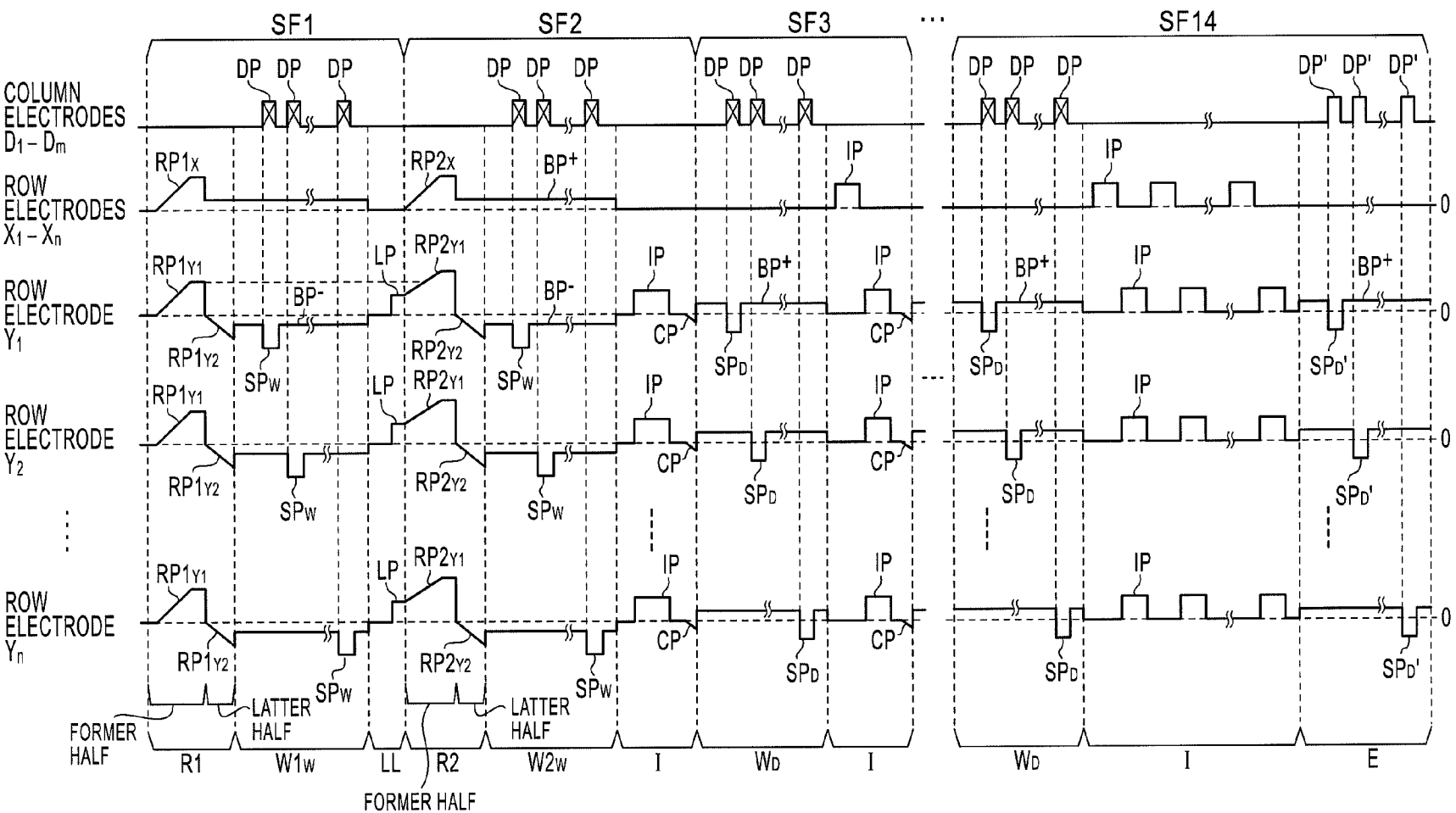
FIG. 14 is a figure showing various drive pulses to be applied to the PDP according to the light emission drive sequence of FIG. 12.

The panel driver, i.e. X-electrode driver 51, Y-electrode driver 53 and address driver 55, generates various drive pulses as shown in FIG. 14 according to various control signals supplied from the drive control circuit 56 and supplies those to the column electrodes D and row electrodes X, Y of the PDP 50.

FIG. 14 representatively shows only the operations in the SF1-SF3 and the last sub-field SF14, out of the sub-fields SF1-SF14 shown in FIG. 12. In FIG. 14, identical reference is used for the identical pulse to the various drive pulses to be generated in employing a selective erase-addressing scheme as shown in FIG. 8.

At first, in the former half of the first reset stage R1 of the sub-field SF1, the Y-electrode driver 53 applies to all the row electrodes $Y_1$-$Y_n$ a positive reset pulse $RP1_{Y1}$ having a waveform moderate in potential transition at the leading edge with respect to the passage of time as compared to that of a sustain pulse to be generated in the sustain stage I. In this duration, the X-electrode driver 51 applies to all the row electrodes $X_1$-$X_n$ a reset pulse $RP1_x$ same in polarity as the reset pulse $RP_{Y1}$ and having a peak potential capable of preventing a surface discharge from occurring between the row electrodes X and Y upon the application of the rest pulse $RP1_{Y1}$. In this duration, unless a surface discharge occurs between the row electrodes X and Y, the X-electrode driver 51 may set all the row electrodes $X_1$-$X_n$ at a ground potential (0 volt) instead of applying the reset pulse $RP1_x$. Here, in the former half of the first reset stage R1, a weak first reset discharge is caused between the row electrode Y and the column electrode D in all the display cells PCs by the application of the reset pulse $RP1_{Y1}$ as noted before. Namely, in the former half of the first reset stage R1, a cathode-at-column discharge is caused as a first reset discharge to flow a current from the row electrode Y to the column electrode D by applying a voltage between the both electrodes such that the row electrode Y is on the anode side and the column electrode D on the cathode side. In response to the first reset discharge, wall charges are formed negative nearby the row electrode Y and positive nearby the column electrode D in all the display cells PC.

In the latter half of the first reset stage R1 of the sub-field SF1, the Y-electrode driver 53 generates a negative reset pulse $RP1_{Y2}$ that is moderate in potential transition at the leading edge with respect to the passage of time and applies it to all the row electrodes $Y_1$-$Y_n$. In this duration, the X-electrode driver 51 sets all the row electrodes $X_1$-$X_n$ at ground potential (0 volt). In the latter half of the first reset stage R1, second reset discharge is caused between the row electrodes X and Y in all the display cells PCs by the application of the reset pulse $RP1_{Y2}$. The second reset discharge erases away the wall charges formed nearby the row electrodes X and Y in the display cells PCs, to initialize all the display cells PCs in the OFF mode. Furthermore, by the application of the reset pulse $RP1_{Y2}$, weak discharge is caused between the row electrode Y and the column electrode D in all the display cells PCs. The weak discharge erases away part of the positive wall charges formed nearby the column electrode D and adjusts those into an amount to correctly cause a selective write-address discharge in the first selective write-address stage $W1_w$, referred later.

In the first selective write-address stage $W1_w$ of the sub-field SF1, the Y-electrode driver 53 applies a write scanning pulse $SP_w$ having a negative peak potential selectively, in order, to the row electrode $Y_1$-$Y_n$ while simultaneously applying to the row electrodes $Y_1$-$Y_n$ a negative base pulse $BP^-$ having a predetermined base potential as shown in FIG. 14. On this occasion, the address driver 55 first converts the pixel-drive data bit corresponding to the sub-field SF1 into a pixel-data pulse DP having a pulse voltage commensurate with the logic level thereof. For example, when supplied with pixel-drive data bit having a logic level 1 for setting the display cell PC in the ON mode, the address driver 55 converts it into a pixel-data pulse DP having a positive peak potential. Further, the address driver 55 converts the pixel-drive data bit having a logic level 0, to set the display cell PC in the OFF mode, into a pixel data pulse DP having a low voltage (0 volt). The address driver 55 applies the pixel data pulse DP in an amount of one display line (m in the number) per time to the column electrode $D_1$-$D_m$ synchronously with the application timing of the write scanning pulse $SP_w$. Selective write-address discharge is caused between the column electrode D and the row electrode Y in the display cell PC where a high-voltage pixel data pulse DP is applied for setting into the ON mode simultaneous with the write scanning pulse $SP_w$. In this duration, voltage is applied also between the row electrodes X and Y in accordance with the write scanning pulse $SP_w$. However, discharge is not caused between the row electrodes X and Y by only the application of the write scanning pulse $SP_w$ because all the display cells PCs are in the OFF mode in this stage, i.e. in a state the wall charges are erased away.

Accordingly, in the first selective write-address stage $W1_w$ of the sub-field SF1, selective write-address discharge is caused only between the column electrode D and the row electrode Y in the display cell PC by the application of the write scanning pulse $SP_w$ and high-voltage pixel-data pulse DP. This sets the display cell PC in the ON mode that wall charges are formed positive nearby the row electrode Y and negative nearby the column electrode D despite no wall charges exist nearby the row electrode X. Meanwhile, selective write-address discharge, like the above, is not caused between the column electrode D and the row electrode Y in the display cell PC to which low-voltage (0 volt) pixel-data pulse DP is applied for setting into the OFF mode simultaneously with the write scanning pulse $SP_w$. Accordingly, the relevant display cell PC remains in the OFF mode initialized in the first reset stage R1, i.e. in a state discharge is not to occur at neither of between the row electrode Y and the column electrode D nor between the row electrodes X and Y.

In the slight-emission stage LL of the sub-field SF1, the Y-electrode driver 53 applies a slight-emission pulse LP having a positive, predetermined peak potential as shown in FIG. 14, simultaneously to the row electrodes $Y_1$-$Y_n$. By the application of the slight-emission pulse LP, discharge is caused between the column electrode D and the row electrode Y in the display cell PC being set in the ON mode (hereinafter, referred to as slight emission discharge). Namely, in the slight-emission stage LL, by applying the row electrode Y with a potential to cause discharge between the row electrode Y and the column electrode D in the display cell PC without causing discharge between the row electrodes X and Y, slight emission discharge is caused only between the column electrode D and the row electrode Y in the display cell PC being set in the ON mode. In this case, the slight-emission pulse LP has a peak potential lower than the peak potential of the sustain pulse IP to apply in the sustain stage I of the sub-field SF2 and the subsequent, e.g. equal to the base potential to be applied to the row electrode Y in the selective erase-address stage $W_D$, referred later.

Further, as shown in FIG. 14, the slight-emission pulse LP has a change rate in a potential rise section with time is given higher than the change rate of the reset pulse ($RP1_{Y1}$, $RP2_{Y1}$) in a rise section thereof. By making more sharp the potential transition of the slight-emission pulse LP at its leading edge more sharp than the potential transition of the reset pulse LP at the leading edge thereof, discharge is caused stronger than the first reset discharge to be caused in the first and second reset stages R1, R2. Here, because such discharge is of a cathode-at-column discharge and caused by slight-emission pulse LP lower in pulse voltage than the sustain pulse IP, the luminance of light emission caused by the discharge is lower than that of a sustain discharge caused between the row electrodes X and Y in the sustain stage I. Namely, in the slight-emission stage LL, discharge is caused at a higher emission luminance level than the first reset discharge but lower than the sustain level, i.e. discharge is caused as a slight-emission discharge with a slight emission in a degree usable for display. In this case, in the first selective write-address stage W1$w$ to be executed immediately before the slight-emission stage LL, selective write-address discharge is caused between the column electrode D and the row electrode Y in the display cell PC. Accordingly, in the sub-field SF1, luminance is expressed at a level correspondingly to the one level higher than the luminance level 0, due to the emissions caused by the selective write-address discharge and slight-emission discharge.

After the slight-emission discharge, wall charges are formed negative nearby the row electrode Y and positive nearby the column electrode D.

In the former half of the second reset stage R2 of the sub-field SF2, the Y-electrode driver 53 applies to all the row electrodes $Y_1$-$Y_n$ a positive reset pulse $RP2_{Y1}$ having a waveform moderate in potential transition at the leading edge with the passage of time as compared to that of the sustain pulse. The reset pulse $RP2_{Y1}$ has a peak potential higher than the peak potential of the reset pulse $RP1_{Y1}$. In this duration, the address driver 55 sets the column electrodes $D_1$-$D_m$ at a ground potential (0 volt) while the X-electrode driver 51 applies to all the row electrodes $X_1$-$X_n$ a positive reset pulse $RP2_X$ having a peak potential capable of preventing a surface discharge from occurring between the row electrodes X and Y due to the application of the reset pulse $RP2_{Y1}$. Provided that a surface discharge does not occur between the row electrodes X and Y the X-electrode driver 51 may set all the row electrodes $X_1$-$X_n$ at ground potential (0 volt) instead of applying a reset pulse $RP2_X$. By the application of the reset pulse $RP2_{Y1}$, first reset discharge is caused weaker than the cathode-at-column discharge in the slight-emission stage LL, between the row electrode Y and the column electrode D in the display cell PC, that a cathode-at-column discharge has not been caused in the slight-emission stage LL, out of the display cells PCs. Namely, in the former half of the second reset stage R2, by applying a voltage between the both electrodes such that the row electrode Y is on the anode side and the column electrode D on the cathode side, cathode-at-column discharge is caused as the first reset discharge to flow a current from the row electrode Y to the column electrode D. In the display cell PC that slight-emission discharge has been already caused in the slight-emission stage LL, discharge is not caused even if the reset pulse $RP2_{Y1}$ is applied. Accordingly, immediately after terminating the former half of the second reset stage R2, all the display cell PCs are placed in a state that wall charges are formed negative nearby the row electrode Y and positive nearby the column electrode D.

In the latter half of the second reset stage R2 of the sub-field SF2, the Y-electrode driver 53 applies a negative reset pulse $RP2_{Y2}$ that is moderate in potential transition at the leading edge with respect to the passage of time, to the row electrodes $Y_1$-$Y_n$. Furthermore, in the latter half of the second reset stage R2, the X-electrode driver 51 applies a positive base pulse $BP^+$ having a predetermined base potential to the row electrodes $X_1$-$X_n$. In response to the application of the negative reset pulse $RP2_{Y2}$ and positive base pulse $BP^+$, second reset discharge is caused between the row electrodes X and Y in all the display cells PCs. The reset pulse $RP2_{Y2}$ and the base pulse $BP^+$ each have a peak potential given minimally to cause second reset discharge positively between the row electrodes X and Y in consideration of the wall charges to be formed nearby the row electrodes X and Y in response to the first reset discharge. The reset pulse $RP2_{Y2}$ is set with a negative peak potential higher in value than the peak potential of the negative write scanning pulse $SP_w$, i.e. at a voltage approximate to 0 volt. Namely, this is because, if providing the peak potential of the reset pulse $RP2_{Y2}$ lower than the peak potential of the write scanning pulse $SP_w$, strong discharge results between the row electrode Y and the column electrode D to thereby greatly erase the wall charges formed nearby the column electrode D and hence make unstable the address discharge in the second selective write-address stage $W2_w$. By the second reset discharge caused in the latter half of the second reset stage R2, erased are the wall charges that have been formed nearby the row electrodes X, Y in each of the display cells PCs thus initializing all the display cells PCs in the OFF mode. Furthermore, in response to the application of the reset pulse $RP2_{Y2}$, weak discharge is caused between the row electrode Y and the column electrode D in all the display cells PCs. Due to the discharge, the positive wall charges formed nearby the column electrode D are partly erased away and adjusted into the amount that selective write-address discharge is to be caused correctly in the second selective write-address stage $W2_w$.

In the second selective write-address stage $W2_w$ of the sub-field SF2, the Y-electrode driver 53 applies a write scanning pulse $SP_w$ having a negative peak potential selectively, in order, to the row electrode $Y_1$-$Y_n$ while simultaneously applying to the row electrodes $Y_1$-$Y_n$ a negative base pulse $BP^-$ having a predetermined base potential as shown in FIG. 14. The X-electrode driver 51 continuously applies to the row electrodes $X_1$-$X_n$ the base pulse $BP^+$ applied to the row electrodes $X_1$-$X_n$ in the latter half of the second reset stage R2. The base pulses $BP^-$, $BP^+$ have respective potentials set at such a potential that the voltage of between the row electrodes X and Y, in the non-application stage of the write scanning pulse $SP_w$, is lower than a discharge start voltage at the display cell PC. Furthermore, in the second selective write-address stage $W2_w$, the address driver 55 first converts the pixel-drive data bit corresponding to the sub-field SF2 into a pixel data pulse DP having a pulse voltage commensurate with the logic level thereof. For example, when supplied with pixel-drive data bit having a logic level 1 for setting the display cell PC in the ON mode, the address driver 55 converts it into a pixel-data pulse DP having a positive peak potential. For pixel-drive data bit having a logic level 0 for setting the display cell PC in the OFF mode, it is converted into a pixel-data pulse DP having a low voltage (0 volt). The address driver 55 applies such pixel-data pulses DP in an amount of one display line (m in the number) per time to the column electrodes $D_1$-$D_m$ synchronously with the application timing of the write scanning pulses $SP_w$. On this occasion, selective write-address discharge is caused between the column electrode D and the row electrode Y in the display cell PC to which a high-voltage pixel data pulse DP has been applied for setting into the ON mode simultaneously with the write scanning pulse $SP_w$. Immediately after the selective write-address discharge, weak discharge is also caused between the row electrodes X and Y of the relevant display cell PC. Namely, although a voltage commensurate with the base pulse $BP^-$ or $BP^-$ is applied between the row electrodes X and Y after the application of the write scanning pulse $SP_w$, the relevant voltage is set at a voltage lower than the discharge start voltage at the display cells PCs so that discharge is not to be caused in the display cell PC by only the application of that voltage. Nevertheless, when selective write-address discharge is caused, discharge arises between the row electrodes X and Y with the sole application of the voltage based on a base pulse $BP^-$, $BP^+$, due to the inducement of the selective write-address discharge. Such discharge is not caused in the first selective write-address stage $W1_X$ wherein a base pulse $BP^+$ is not applied to the row electrode X. By such discharge together with the selective write-address discharge, the display cell PC is set in a state that wall charges are formed positive nearby the row electrode Y, negative nearby the row electrode X and negative nearby the column electrode D, i.e. in the ON mode. Such selective write-address discharge is not caused between the column electrode D and the row electrode Y in the display cell PC to which applied are a pixel data pulse DP having a low voltage (0 volt) for setting into the OFF mode simultaneously with the write scanning pulse $SP_w$. Accordingly, discharge is not to occur between the row electrodes X and Y. Therefore, the display cell PC remains in its state, i.e. in the OFF mode that initialization is made in the second reset stage R2.

In the sustain stage I of the sub-field SF2, the Y-electrode driver 53 generates a sustain pulse IP having positive peak potential in an amount of one pulse and applies it simultaneously to the row electrodes $Y_1$-$Y_n$. In this duration, the X-electrode driver 51 sets the row electrodes $X_1$-$X_n$ at a ground potential (0 volt) while the address driver 55 sets the column electrodes $D_1$-$D_m$ at a ground potential (0 volt). In response to the application of the sustain pulse IP, sustain discharge is caused between the row electrodes X and Y in the display cell PC being set in the ON mode. Due to the sustain discharge, the phosphor layer 17 gives off light toward the outside through the front transparent substrate 10, thus effecting once emission of display light correspondingly to the weight of luminance for the sub-field SF2. In response to the application of the sustain pulse IP, discharge is also caused between the row electrode Y and the column electrode D in the display cell PC being set in the ON mode. By such discharge together with the sustain discharge, negative wall charges are formed nearby the row electrode Y in the display cell PC while positive wall charges are formed nearby the row electrode X and the column electrode D. After the application of the sustain pulse IP, the Y-electrode driver 53 applies to the row electrodes $Y_1$-$Y_n$ a wall-charge adjust pulse CP moderate in potential transition at the leading edge with respect to the passage of time and having a negative peak potential, as shown in FIG. 14. In response to the application of the wall-charge adjust pulse CP, erase discharge is caused weak in the display cell PC where sustain discharge is caused, thereby erasing part of the wall charges formed at the inside thereof. This adjusts the wall charges in the display cell PC into such an amount that can correctly cause selective erase-address discharge in the next selective erase-address stage $W_D$.

In the selective erase-address stage $W_0$ in each of the sub-fields SF3-SF14, the Y-electrode driver 53 applies an erase scanning pulse $SP_D$ having a negative peak potential as shown in FIG. 14 selectively, in order, to the row electrodes $Y_1$-$Y_n$ while applying a positive base pulse $BP^+$ having a predetermined base potential to the row electrodes $Y_1$-$Y_n$. The peak potential of the base pulse $BP^+$ is set at a potential for preventing an erroneous discharge from occurring between the row electrodes X and Y during execution of the selective erase-address stage $W_0$. During execution of the selective erase-address stage $W_0$, the X-electrode driver 51 sets the row electrodes $X_1$-$X_n$ at a ground potential (0 volt). In the selective erase-address stage $W_0$, the address driver 55 first converts the pixel-drive data bit corresponding to the relevant sub-field SF into a pixel-data pulse DP having a pulse voltage commensurate with the logic level thereof. For example, when supplied with pixel-drive data bit having a logic level 1 for transiting the display cell PC from the ON to OFF mode, the address driver 55 converts it into a pixel-data pulse DP having a positive peak potential.

When supplied with pixel-drive data bit having a logic level 0 for maintaining the display cell PC in its current status, it is converted into a pixel-data pulse DP having a low voltage (0 volt). The address driver 55 applies the pixel-data pulse DP in an amount of one display line (m in the number) per time to the column electrodes $D_1$-$D_m$ synchronously with the application timing of the erase scanning pulse $SP_D$. On this occasion, selective erase-address discharge is caused between the column electrode D and the row electrode Y in the display cell PC to which the high-voltage pixel-data pulse DP is applied simultaneously with the erase scanning pulse $SP_D$. By the selective erase-address discharge, the relevant display cell PC is set in a state that positive wall charges are formed nearby the row electrodes Y and X while negative wall charges are nearby the column electrode D, i.e. in the OFF mode. Such selective erase-address discharge is not caused between the column electrode D and the row electrode Y in the display cell PC to which a low-voltage (0 volt) pixel data pulse DP is applied simultaneously with the erase scanning pulse $SP_D$. Accordingly, the relevant display cell PC remains in its state (in the ON mode or in the OFF mode).

In the sustain stage I of each of the sub-fields SF3-SF14, the X-electrode and Y-electrode drivers 51, 53 alternately apply sustain pulses IP having a positive peak potential respectively to the row electrodes $X_1$-$X_n$ and $Y_1$-$Y_n$, repeatedly in the (even) number of times corresponding to the weighting of luminance for the relevant sub-field, as shown in FIG. 14. Each time the sustain pulse IP is applied, sustain discharge is caused between the row electrodes X and Y in the display cell PC being set in the ON mode. Due to the sustain discharge, the light given off from the phosphor layer 17 is emitted to the outside through the front transparent substrate 10, thus effecting emissions of display light in the number of times corresponding to the weighting of luminance for the relevant sub-field SF. On this occasion, in the sustain stage I of each of the sub-fields SF2-SF14, wall charges are formed negative nearby the row electrode Y and positive nearby the row and column electrodes X, D in the display cell PC where sustain discharge is caused according to the last applied sustain pulse IP. After the application of the last sustain pulse IP, the Y-electrode driver 53 applies to the row electrodes $Y_1$-$Y_n$ a wall-charge adjust pulse CP having a negative peak potential moderate in potential transition at the leading edge with respect to the passage of time, as shown in FIG. 14. In response to the application of the wall-charge adjust pulse CP, erase discharge is caused weak in the display cell PC where sustain discharge is caused as in the above, thus erasing away part of the wall charges formed therein. Due to this, the wall charges in the display cell PC are adjusted into an amount that selective erase-address discharge is to be correctly caused in the next selective erase-address stage $W_D$.

After terminating the sustain stage I of the last sub-field SF14, the erase stage E is executed. In the erase stage E, the Y-electrode driver 53 applies an erase scanning pulse $SP_D'$ having a negative peak potential as shown in FIG. 14 selectively, in order, to the row electrodes $Y_1$-$Y_n$ while applying a positive base pulse $BP^+$ having a predetermined base potential to the row electrodes $Y_1$-$Y_n$. The peak potential of the base pulse $BP^+$ is set at a potential for preventing an erroneous discharge from occurring between the row electrodes X and Y during execution of the erase stage E. During execution of the erase stage E, the X-electrode driver 51 sets the row electrodes $X_1$-$X_n$ at a ground potential (0 volt).

In the erase stage E, in order to place all the display cells PCs into the OFF mode, the address driver 55 applies address pulses DP, as erase pulses, in an amount of one display line (m in the number) per time to the column electrodes $D_1$-$D_m$ synchronously with the application timing of the erase scanning pulses $SP_D'$ similarly to the case supplied with the pixel-drive data bit having a logic level 1. On this occasion, erase discharge is caused between the column electrode D and the row electrode Y in the display cell PC to which the address pulse DP' is applied simultaneously with the erase scanning pulse $SP_D$ and staying in the ON mode. By the erase discharge, the display cells PCs staying in the ON mode are set in a state that wall charges are formed positive nearby the row electrodes Y and X and negative nearby the column electrode D, i.e. in the OFF mode. For the display cells PCs placed in the OFF mode at or before the sub-field SF13, the OFF mode is maintained. This places all the display cells PCs in the OFF mode.

The above driving is implemented based on 16 patterns of pixel drive data GD as shown in FIG. 13.

At first, in the second gradation at which luminance is to be represented one level higher than the first gradation to exhibit black display (luminance level 0), selective write-address discharge is caused for setting the display cell PC in the ON mode, only in SF1 out of the sub-fields SF1-SF14 as shown in FIG. 13. Thus, the display cell PC set in the ON mode is caused to discharge with slight emission (shown with a square). In this case, the luminance of the emission, based on the selective write-address discharge and slight-emission discharge, is lower in level than the luminance of the emission due to once sustain discharge. Accordingly, at the second gradation, luminance to exhibit corresponds to a luminance level "α" lower than the luminance level "1" provided that the luminance to be perceived upon a sustain discharge is "1".

In the third gradation at which luminance is to be represented one level higher than the second gradation, selective erase-address discharge is caused (shown with a double circle) for setting the display cell PC in the ON mode, only in SF2 out of the sub-fields SF1-SF14, followed by causing a selective erase-address discharge to transit the display cell PC into the OFF mode in the next sub-field SF3 (shown with a black circle). Accordingly, in the third gradation, light emission is effected based on once sustain discharge only in the sustain stage I of SF2 out of the sub-fields SF1-SF14, thus representing a luminance corresponding to the luminance level "1".

In the fourth gradation at which luminance is to be represented one level higher than the third gradation, selective write-address discharge is first caused for setting the display cell PC in the ON mode in the sub-field SF1, thus causing the display cell PC set in the ON mode to discharge with slight emission (shown at a square). Furthermore, in the fourth gradation, selective write-address discharge is caused (shown at a double circle) for setting the display cell PC in the ON mode only in SF2 out of the sub-fields SF1-SF14, followed by causing a selective erase-address discharge to transit the display cell PC into the OFF mode in the next sub-field SF3 (shown with a black circle). Accordingly, in the fourth gradation, light emission is effected at a luminance level "α" in the sub-field SF1 and sustain discharge is once effected with light emission at a luminance level "1" in SF2, thus representing a luminance corresponding to the luminance level "α"+"1".

In each of the fifth to sixteenth gradations, selective write-address discharge is caused for setting the display cell PC in the ON mode in the sub-field SF1, to cause a discharge with slight emission in the display cell PC being set in the ON mode (shown with a square). Then, selective erase-address discharge is caused to transit the display cell PC into the OFF mode, only in one sub-field corresponding to the luminance level (shown with a black circle). Accordingly, in each of the fifth to sixteenth gradations, slight-emission discharge is caused in the sub-field SF1. After causing once sustain discharge in SF2, sustain discharge is caused in the number of times assigned to the sub-field, in the sub-fields successive in the number (shown with white circles) corresponding to the relevant luminance level. Due to this, in each of the fifth to sixteenth gradations, visual perception is at a luminance correspondingly to the level of "α"+"total number of sustain discharges caused within the one-field (one-frame) display period".

Namely, with the driving as shown in FIG. 13, luminance in a range of from "0" to "255+α" is to be expressed with sixteen levels, as shown in FIG. 13.

In such driving scheme, there is no possibility that emission-pattern inverted regions (ON and OFF) coexist on one display screen in the one-field display period, which prevents a false contour from occurring in such a situation.

In the driving scheme shown in FIG. 14, cathode-at-column discharge is caused as a first reset discharge to flow a current from the row electrode Y to the column electrode D by applying a voltage between the both electrodes such that the row electrode Y is on the anode side and the column electrode D on the cathode side, in the first and second reset stages R1, R2 of the respective sub-fields SF1, SF2. Accordingly, during the first reset discharge, the positive ion in a discharge gas is allowed to collide with the MgO crystallization, i.e. secondary-electron emission material, contained in the FIG. 5 phosphor layer 17 in the course traveling toward the column electrodes D, thus causing a secondary electron to emit from the MgO crystallization. Particularly, in the PDP 50 of the plasma display shown in FIG. 1, by exposing the MgO crystallization in a discharge space as shown in FIG. 5, the probability of collision is raised to efficiently emit a secondary electron into the discharge space. By doing so, the discharge start voltage at the display cell lowers due to the priming action of the secondary electron, making it possible to cause a comparatively weal reset discharge. Because the luminance of discharge emission is lowered by the weakened reset discharge, display can be at an improved contrast in dark-image display, i.e. dark contrast.

In the driving scheme shown in FIG. 14, first reset discharge is caused between the row electrode Y formed on the front transparent substrate 10 and the column electrode D formed on the back substrate 14, as shown in FIG. 3. This reduces the discharge-based light emitting to the outside through the front transparent substrate, as compared to the case to cause a discharge between row electrodes X and Y both formed on the front transparent substrate. Thus, dark contrast can be improved furthermore.

In the driving scheme shown in FIGS. 12 to 14, reset discharge is caused to initialize all the display cells PCs into the OFF mode in the beginning sub-field SF1, followed by causing a selective write-address discharge to transit the display cells PCs staying OFF into the ON mode. In each of the sub-fields SF3-SF14 following SF2, driving is performed with a selective erase-address scheme for causing a selective erase-address discharge in order to transit the display cell PC staying ON mode into the OFF mode. Accordingly, in case making a black display (at a luminance level 0) on the driving according to the first gradation as shown in FIG. 6, the discharge to be caused in the one-field display period is limited to the reset discharge in the beginning sub-field SF1. Therefore, the discharges to cause within the one-field display period is reduced in the number of times as compared to the case employing the driving for causing a selective erase-address discharge to cause a reset discharge, all the display cells PCs are initialized into the ON mode in the sub-field SF1, and then transit it into the OFF mode. This can improve the dark contrast.

In the driving scheme shown in FIGS. 12 to 14, slight-emission discharge, instead of sustain discharge, is caused as a discharge contributing to a display image in the sub-field SF1 the smallest in the weighting of luminance. In this case, the slight-emission discharge is lower in the level of luminance due to discharge emission as compared to the sustain discharge occurring between the row electrodes X and Y because it is caused between the column electrode D and the row electrode Y. Accordingly, in the case of representing a luminance level one level higher (second intensity) than black display (luminance level 0) by means of a slight-emission discharge, the difference in luminance from the luminance level 0 is smaller as compared to the case representing it with a sustain discharge. This improves the capability of representing an image low in luminance. Furthermore, in the second gradation, because reset discharge is not caused in the second reset stage R2 of SF2 following the sub-field SF1, dark contrast is suppressed from lowering due to the reset discharge.

In the driving scheme shown in FIG. 14, the reset pulse $RP1_{Y1}$, to be applied to the row electrode Y in order to cause a first reset discharge in the first reset stage R1 of the sub-field SF1, is given lower in peak potential than the reset pulse $RP2_{Y1}$, to be applied to the row electrode Y in order to cause a first reset discharge in the second reset stage R2 of the sub-field SF2. Due to this, dark contrast is suppressed from lowering by weakening the light emission based on a simultaneous reset discharge at all the display cells PCs, in the first reset stage R1 of the sub-field SF1.

In the driving scheme shown in FIGS. 12 to 14, sustain discharge is caused once in the sustain stage I of the sub-field SF2 second smaller in the weighting of luminance, thereby enhancing the capability of representing an image low in luminance. In the sustain stage I of the sub-field SF2, there is only one sustain pulse IP that is applied in order to cause a sustain discharge. After terminating the sustain discharge caused in response to the once sustain pulse IP, wall charges are formed negative nearby the row electrode Y and positive nearby the column electrode D. This makes it possible to cause a discharge, as a selective erase-address discharge, between the column electrode D and the row electrode Y with the column electrode D rendered as an anode (hereinafter, anode-at-column discharge), in the selective erase-address stage $W_D$ of the next sub-field SF3. In the sustain stage I in each of the following sub-fields SF3-SF14, the number of times of sustain pulse I applications is taken as an even number. Because wall charges are formed negative nearby the row electrode Y and positive nearby the column electrode D immediately after terminating the sustain stage I, anode-at-column discharge is available in the selective erase-address stage $W_D$ to be executed following the sustain stage I. For this reason, the column electrode D is to be merely applied with a positive pulse, thus suppressing the address driver 55 from cost-increasing.

In the driving scheme shown in FIGS. 12 to 14, there is an effect that discharge probability is raised by the priming-particle emitting action from the secondary-electron emission material, particularly the CL-emission MgO crystallization, of the phosphor layer 17. In the erase stage E, when an erase pulse is applied simultaneously to all the display cells PCs, discharge occurs between the row electrode Y and the column electrode D instantaneously, nearly simultaneously in all the display cells PCs staying in the ON mode. In such a case, a large current is to flow because discharge occurs nearly simultaneously in a number of display cells PCs. The large current distorts the waveform of the erase pulse with a result that erase discharge weakens. In such a case, there possibly occurs a display cell PC not to be completely placed in an erase mode in respect of wall charge. Against such a disadvantage, by employing, a structure for performing erasure sequentially on a scan-line-by-scan-line basis as in the FIG. 14 structure, there is eliminated the instantaneous flow of a large current thus allowing for performing stable erase discharge. Accordingly, all the display cells PCs can be set positively in the OFF mode in the erase stage E.

In the driving scheme shown in FIGS. 12 to 14, slight-emission discharge is caused with a light emission at a luminance level α in the sub-field SF1, also in the level of the fourth gradation or higher. Alternatively, such slight-emission discharge may not be caused in the level of the third gradation or higher. In brief, because the light emission caused by a slight-emission discharge is extremely low in luminance (luminance level α), there is no need to cause such a slight-emission discharge when using together a sustain discharge with a higher luminance of light emission, i.e. when a luminance increase of "luminance level α" can not be visually perceived in the level of the third gradation or higher.

Figure 15:
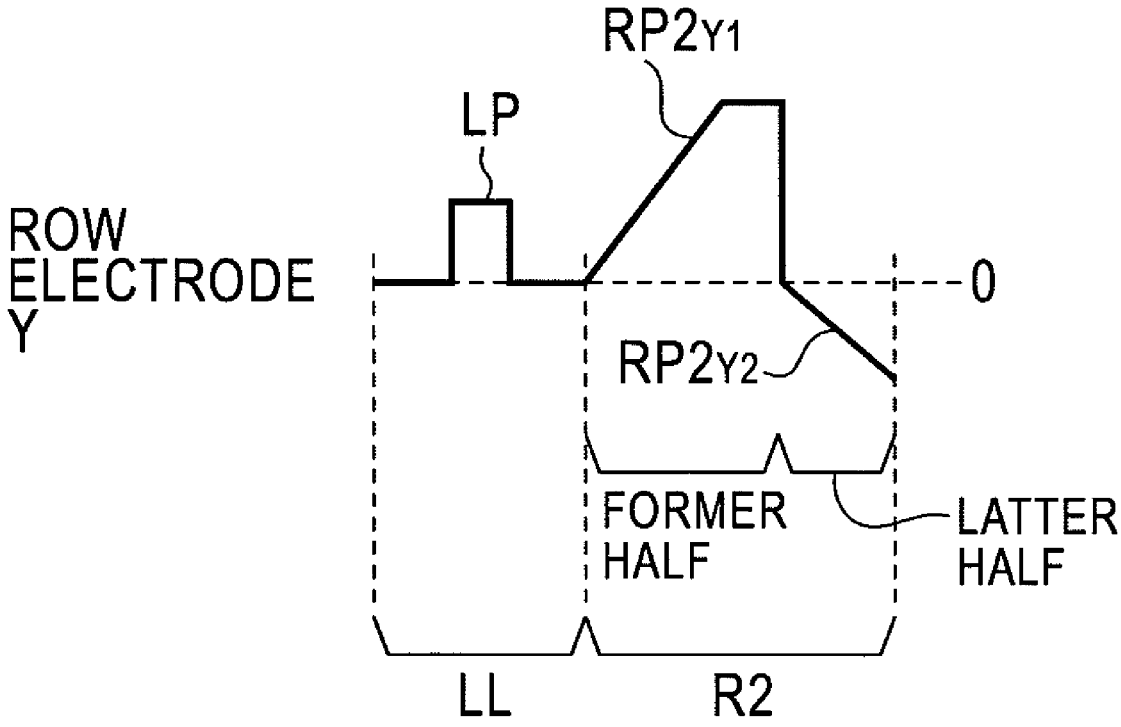
FIG. 15 is a figure showing a modification of the slight-emission pulse and reset pulse of FIG. 14.

In the embodiment shown in FIG. 14, the slight-emission pulse LP and the reset pulse $RP\mathbf{2}_{Y1}$ are coupled together and applied to the row electrodes Y. Alternatively, the both may be applied separately in time, in order, to the Y electrodes as shown in FIG. 15.

Further, in the reset stage R shown in FIG. 14, reset discharge is caused simultaneously in all the display cells PCs. Alternatively, reset discharge may be executed separately in time on a pixel-cell-block-by-pixel-cell-block basis wherein each is formed by a plurality of display cells.

Figure 16:
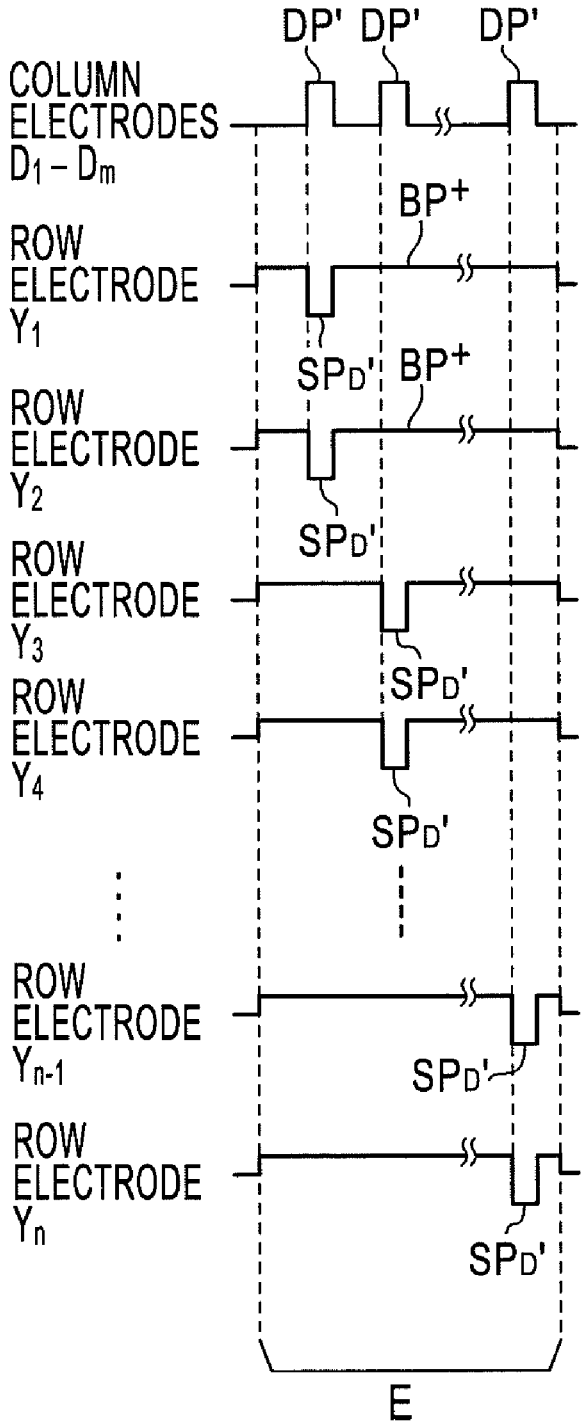
FIG. 16 is a figure showing an example of erase pulse application for each scanning line group in an erase stage.

In the foregoing embodiments, the scanning pulse $SP_D'$, which is applied in the erase stage E, is line-sequentially applied for each scanning line, thereby sequentially effect erasure on a scanning-line-by-scanning-line basis. In the invention, the scanning pulse $SP_D'$ may be applied for each scanning line group which is formed by a plurality of scanning lines as shown in FIG. 16, in place of performing erasure line-sequentially on each scanning line basis. Namely, it is possible to use a structure to perform sequential erasure on each scanning-line-group basis by forming a plurality of scanning line groups each of which is formed by a plurality of scanning lines, thereby sequentially applying a scanning pulse $SP_D'$ on each scanning line group wherein the scanning line group is taken as a unit and applying an address pulse DP' to all the column electrodes $D_1$-$D_m$ synchronously with the scanning pulse $SP_D'$. Because erase discharges are satisfactorily not caused simultaneously, similar operation/effect is to be obtained if using a method that erase discharge is decentralized by grouping the scanning lines. By doing so, the erase period E can be reduced in time.

Furthermore, in the foregoing embodiments, the address pulse DP' is applied to all the column electrodes $D_1$-$D_m$ regardless of whether each display cell PC is set in the ON mode or OFF mode at the time of terminating the sustain stage I of the sub-field SF14. Alternatively, the address pulse DP' may be applied only to the display cells being set in the ON mode at the time terminating the sustain stage I of the sub-field SF14. Namely, even unless applying the address pulse DP' to the display cells already set in the OFF mode in advance of the sub-field SF13, it is already in the OFF mode at the time of terminating the sustain stage I of the sub-field SF14. Accordingly, the structure may be to apply an address pulse DP' only to the display cells being set in the ON mode in the sub-field SF14, according to the instruction from the drive control circuit 56. This reduces the number of times of address pulse DP' applications and hence the power consumption as compared to the foregoing embodiment.

Figure 17:
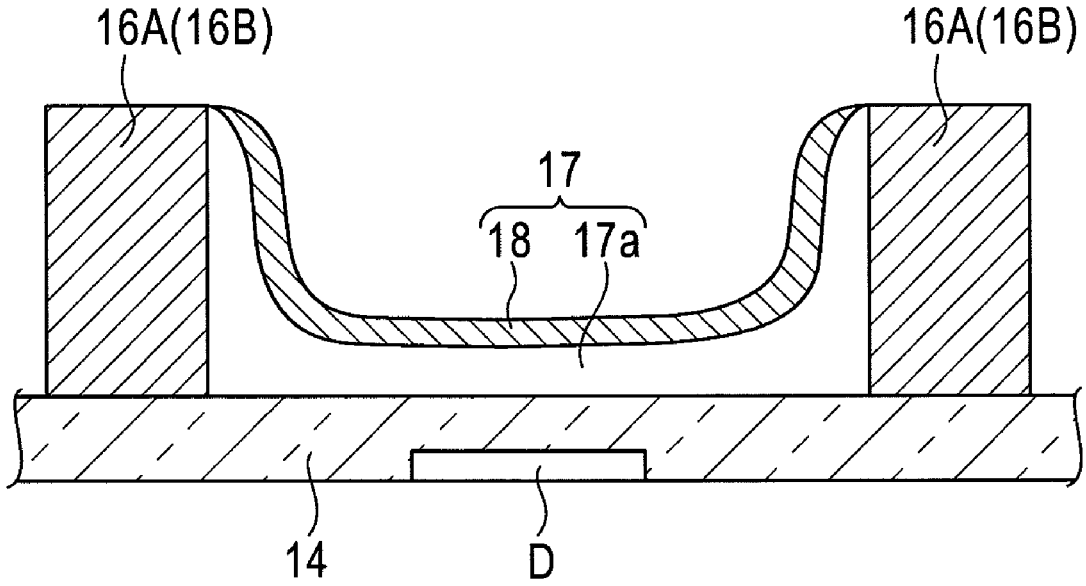
FIG. 17 is a figure showing an example of another structure of a phosphor layer of the display cell in the PDP of FIG. 2.

Incidentally, in FIG. 5, MgO crystallization is contained in the phosphor layer 17 provided on the back substrate 14 of the PDP 50. Alternatively, by providing a secondary-electron emission layer 18 may be formed of secondary-electron emission material in a manner covering the surface of a phosphor grain layer 17*a* as shown in FIG. 17, a phosphor layer 17 may be provided by the phosphor grain layer 17*a* and the secondary-electron emission layer 18 that are layered together. In this case, the secondary-electron emission layer 18 may be formed by laying a crystal of secondary-electron emission material (e.g. MgO crystallization containing a CL-emission MgO crystallization) over the surface of the phosphor grain layer 17*a* or may be formed by film-depositing a secondary-electron emission material.

In FIG. 14, the structure was shown that a positive pulse $RP\mathbf{1}_{Y1}$ is applied to the row electrodes $Y_1$-$Y_n$ in the former half of the reset stage R1 of the sub-field SF1. However, this is not limited to.

Figure 18:
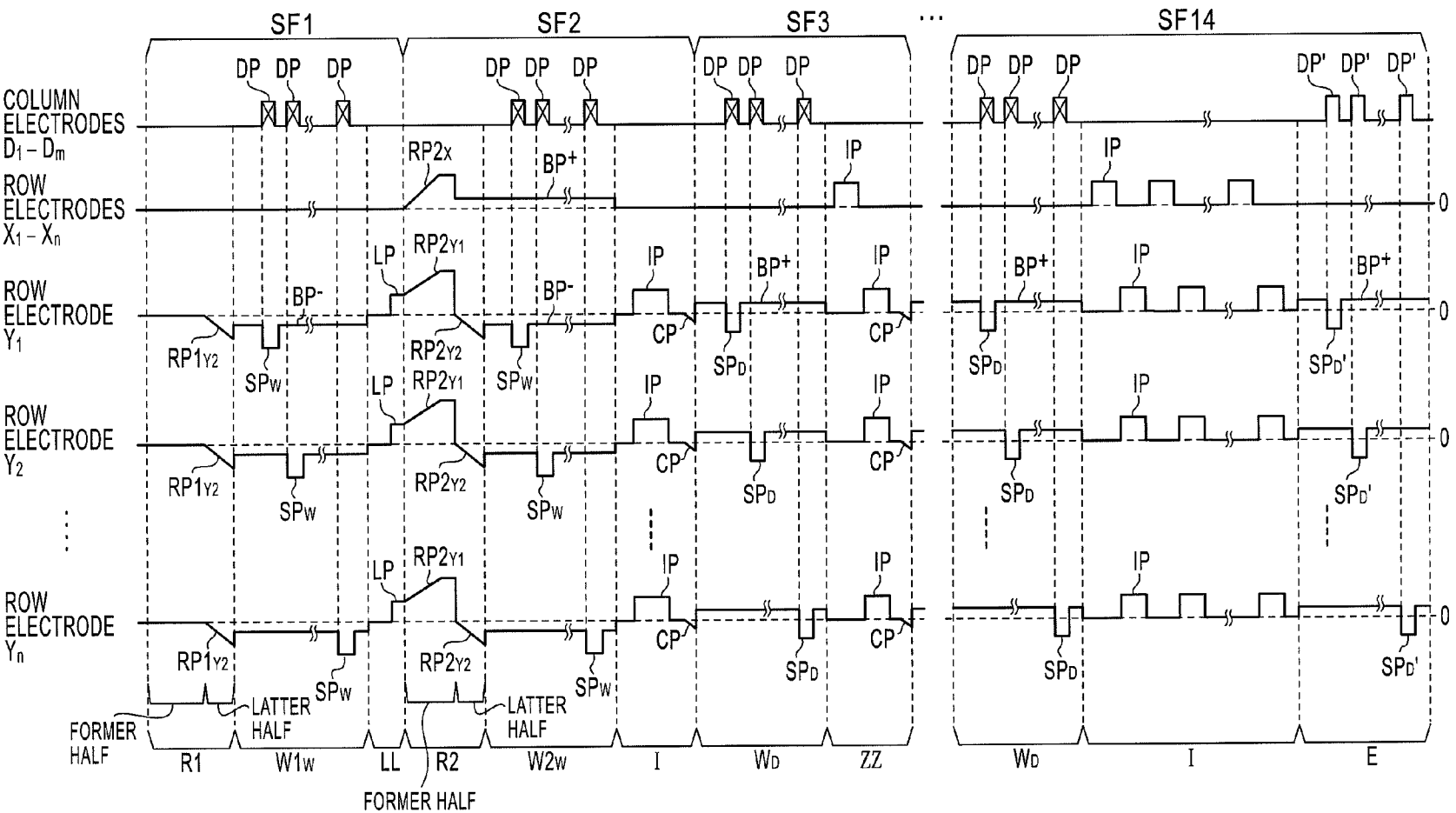
FIG. 18 is a figure showing another example of various drive pulses to be applied to the PDP according to the light emission drive sequence of FIG. 12.

For example, the row electrodes $Y_1$-$Y_n$ may be set at a ground potential in the former half of the reset stage R1, as shown in FIG. 18.

The cathode-at-column discharge, of from the row electrode Y to the column electrode D in the former half of the reset stage R1, mainly aims at emitting priming particles in order to stabilize the write discharge in the first selective write-address stage $W\mathbf{1}_w$. However, when using a structure that a phosphor layer contains therein MgO crystallization containing a CL-emission MgO crystallization, e.g. in FIG. 5 or 17, write discharge stabilizes as compared to the case not using such a structure.

In the case where write discharge stabilizes in the first selective write-address stage W1*w* wherein write discharge stabilizes in the first selective write-address stage $W\mathbf{1}_w$ even unless causing a cathode-at-column discharge in the former half of the reset stage R1, a structure not to cause a discharge can be employed by setting both the row electrodes Y and the column electrodes D at a ground potential. In this case, the row electrodes X are also set with a ground potential as shown in FIG. 18.

Incidentally, in this case, after terminating the reset stage R1, all the display cells are placed in a non-emission state by the discharge in the erasure stage of the preceding field and the discharge caused by the application of the pulse $RP\mathbf{1}_{Y2}$.

As for the cathode-at-column discharge caused by the application of the pulse $RP\mathbf{2}_{Y1}$ in the former half of the reset stage R2 in FIG. 14, the priming particles caused by the reset discharge mainly serves to stabilize a write discharge in the second selective write-address stage $W\mathbf{2}_w$. If omitting to cause a cathode-at-column discharge by the application of the pulse $RP\mathbf{2}_{Y1}$ in the former half of the reset stage R2, sustain discharge does not occur in every sub-field SF subsequent to the sub-field SF2 in the event an mistaken write takes place in the second selective write-address stage $W\mathbf{2}_w$. Accordingly, in the former half of the reset stage R2, it is preferred not to omit a cathode-at-column discharge as caused by the application of the pulse $RP\mathbf{2}_{Y1}$. The matter preferably not to omit is true for the case of a discharge based on the FIG. 8 pulse $RP_{Y1}$.

This application is based on Japanese Patent Application No. 2007-038469 which is hereby incorporated by reference.

What is claimed is:

1. A method for driving a plasma display panel in accordance with pixel data for each pixel based on a video signal, the plasma display panel having first and second substrates which are oppositely arranged sandwiching a discharge space in which discharge gas is filled, a plurality of row electrode pairs formed on the first substrate and each providing a scanning line, and a plurality of column electrode formed on the second substrate, in order to form display cells each including a phosphor layer at intersections of the row electrode pairs and the column electrodes, the method comprising the steps of:

executing a reset stage for initializing the display cells in a beginning sub-field of a plurality of sub-fields into which a one-field display period of the video signal is divided;

executing, in order, an address stage for setting the display cells in an ON mode or OFF mode by causing an address discharge selectively in the display cells in accordance with the pixel data in all of the plurality of sub-fields, and a sustain stage for causing a sustain discharge in each display cell set in the ON mode; and executing an erase stage for setting the OFF mode for all display cells which are in the ON mode following the sustain stage of an end sub-field of the plurality of sub-fields, wherein, in the erase stage, a scanning pulse is sequentially applied to one row electrode of each of the row electrode pairs for each scanning line or for each scanning line group which is formed by a plurality of scanning lines, while an erase pulse is applied to the column electrodes simultaneously with the application of the scanning pulse, to cause an erase discharge between the one row electrode and each of the column electrodes to which the erase pulse is applied.

2. The method according to claim 1, wherein the reset stage is executed further in a beginning of a second sub-field following the beginning sub-field.

3. The method according to claim 1, wherein, in the reset stage, a voltage is applied between the one row electrode of each of the row electrode pairs and each of the column electrodes so that the one row electrode becomes an anode and each of the column electrodes becomes a cathode, to cause a reset discharge between the one row electrode and each of the column electrodes.

4. The method according to claim 3, wherein, in the reset discharge, the other row electrode of each of the row electrode pairs is applied with a potential that prevents a discharge from occurring between the other electrode and the one row electrode.

5. The method according to claim 1, wherein, following the address stage in the beginning sub-field, a sustain discharge pulse is applied only once to the one row electrode thereby executing the sustain stage to cause the sustain discharge only once in each display cell set in the ON mode.

6. The method according to claim 2, wherein, following the address stage in the second sub-field, a sustain discharge pulse is applied only once to the one row electrode thereby executing the sustain stage to cause the sustain discharge only once in each display cell set in the ON mode.

7. The method according to claim 1, wherein the reset stage is executed only in the beginning sub-field of the plurality of sub-fields of each field display period of the video signal.

8. The method according to claim 2, wherein the reset stage is executed only in the beginning sub-field and the second sub-field the sub-field of each field display period of the video signal.

9. The method according to claim 1, wherein a write discharge is selectively generated in the display cells in accordance with the pixel data in the address stage of the beginning sub-field to thereby set the discharged display cells in the ON mode, and the erase discharge is generated selectively in the display cells in accordance with the pixel data in the address stage of each sub-field following the beginning sub-field to thereby set the discharged display cells in the OFF mode.

10. The method according to claim 2, wherein a write discharge is selectively generated in the display cells in accordance with the pixel data in the address stage of each of the beginning and second sub-fields to thereby set the discharged display cell in-the ON mode, and erase discharge is generated selectively in the display cells in accordance with the pixel data in the address stage of each sub-field following the second sub-field to thereby set the discharged display cell in the OFF mode.

11. The method according to claim 3, wherein, in the reset stage, a potential applied to the one row electrode is gradually increased with time to thereby generate the voltage, for causing the reset discharge, between each of the column electrodes and the one row electrode.

12. The method according to claim 1, wherein, in the address stage of the beginning sub-field, a negative potential is applied to the one row electrode while a positive potential is applied to the other row electrode of each of the row electrode pairs.

13. The method according to claim 2, wherein, in the address stage of the second sub-field, a negative potential is applied to the one row electrode while a positive potential is applied to the other row electrode of each of the row electrode pairs.

14. The method according to claim 1, wherein, in the reset stage, a positive potential is applied between the one row electrode and the other row electrode of each of the row electrode pairs.

15. The method according to claim 3, wherein, immediately after the address stage of the beginning sub-field, a voltage is applied between the one row electrode and each of the column electrodes so that the one row electrode becomes an anode and each of the column electrodes becomes a cathode, to execute a slight-emission stage for causing a slight-emission discharge between the column electrode and the one row electrode in each display cell set in the ON mode in the address stage of the beginning sub-field.

16. The method according to claim 15, wherein the slight-emission discharge is a discharge with a light emission corresponding to a gradation of high luminance by one level higher than a luminance level 0.

17. The method according to claim 15, wherein, in the reset stage of the second sub-field, a potential applied, to cause the slight-emission discharge, to the one row electrode is gradually increased with time thereby causing the reset discharge.

18. The method according to claim 15, wherein a change ratio with time in a rise section of a potential applied to the one row electrode in order to cause the slight-emission discharge in the slight-emission stage is higher than a change ratio with time in a rise section of a potential applied to the one row electrode in order to cause the reset discharge.

19. The method according to claim 15, wherein, in each sub-field following the second sub-field, a sustain pulse is applied alternately to the one row electrode and the other row electrode thereby executing the sustain stage to cause the sustain discharge only in each display cell holding the ON mode, and the potential applied to the one row electrode in order to cause the slight-emission discharge in the slight-emission stage is lower than a peak potential of the sustain pulse.

20. The method according to claim 1, wherein the phosphor layer contains a phosphor material and a secondary-electron emission material.

21. The method according to claim 20, wherein the secondary-electron emission material consists of magnesium oxide.

22. The method according to claim 21, wherein the magnesium oxide contains a magnesium oxide crystallization which is excited on an electronic beam to cause a cathode-luminescence emission having a peak at a wavelength of 200-300 nm.

23. The method according to claim 22, wherein the magnesium oxide crystallization is produced by vapor phase oxidation.

24. The method according to claim 20, wherein grains of the secondary-electron emission material are in contact with the discharge gas in the discharge space.

* * * * *